US011148138B2

(12) United States Patent
Perroud et al.

(10) Patent No.: US 11,148,138 B2
(45) Date of Patent: Oct. 19, 2021

(54) MAGNETIC CONDUITS IN MICROFLUIDICS

(71) Applicants: TECAN TRADING AG, Mannedorf (CH); Thomas Perroud, Lexington, MA (US); Dan Tran, San Jose, CA (US); Daniel Hoffmeyer, San Jose, CA (US); Tiffany Lay, San Jose, CA (US); Manjeet Dhindsa, San Jose, CA (US)

(72) Inventors: Thomas Perroud, Lexington, MA (US); Dan Tran, San Jose, CA (US); Daniel Hoffmeyer, San Jose, CA (US); Tiffany Lay, San Jose, CA (US); Manjeet Dhindsa, San Jose, CA (US)

(73) Assignee: TECAN TRADING AG, Mannedorf (CH)

( * ) Notice: Subject to any disclaimer, the term of this patent is extended or adjusted under 35 U.S.C. 154(b) by 690 days.

(21) Appl. No.: 15/756,176

(22) PCT Filed: Sep. 2, 2015

(86) PCT No.: PCT/US2015/048141
§ 371 (c)(1),
(2) Date: Feb. 28, 2018

(87) PCT Pub. No.: WO2017/039654
PCT Pub. Date: Mar. 9, 2017

(65) Prior Publication Data

US 2018/0243743 A1 Aug. 30, 2018

(51) Int. Cl.
*B01L 3/00* (2006.01)

(52) U.S. Cl.
CPC ..... *B01L 3/502715* (2013.01); *B01L 3/508* (2013.01); *B01L 3/50273* (2013.01);
(Continued)

(58) Field of Classification Search
CPC ..... B01L 3/502; B01L 3/502784; B01L 3/502792; B01L 3/508; B01L 3/502761;
(Continued)

(56) References Cited

U.S. PATENT DOCUMENTS 5,486,337 A 1/1996 Ohkawa
6,565,727 B1 5/2003 Shenderov
(Continued)

FOREIGN PATENT DOCUMENTS

WO 2006125767 A1 11/2006
WO 2008106678 A1 9/2008
(Continued)

OTHER PUBLICATIONS

International Search Report for corresponding PCT application No. PCT/US2015/048141, dated May 19, 2016.
(Continued)

*Primary Examiner* — Gurpreet Kaur
(74) *Attorney, Agent, or Firm* — Notaro, Michalos & Zaccaria P.C.

(57) ABSTRACT

A digital microfluidics system with electrodes attached to a substrate and covered by a hydrophobic surface, and a control unit for manipulating liquid droplets by electrowetting; providing in close proximity to electrodes a magnetic conduit for directing a magnetic field of a backing magnet to the first hydrophobic surface; providing on the hydrophobic surface a liquid droplet that has magnetically responsive beads; moving by electrowetting the liquid droplet with the magnetically responsive beads until a part of which is placed atop of the magnetic conduit; actuating the backing magnet
(Continued)

Figure 1:
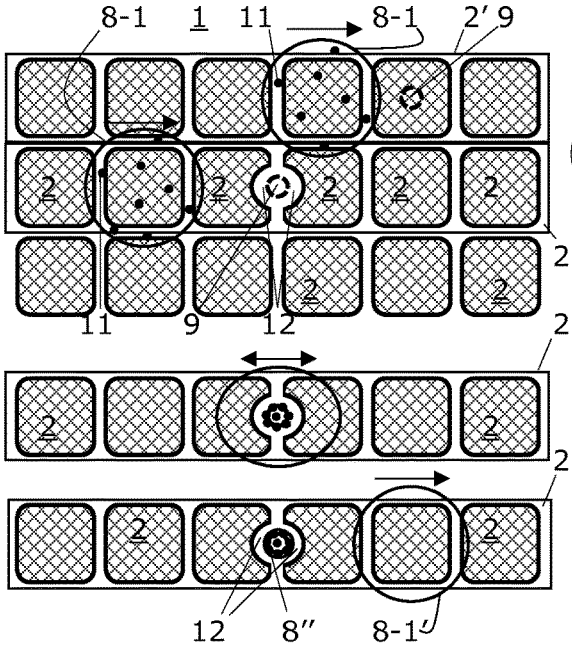

of the magnetic conduit and attracting/concentrating magnetically responsive beads; and while actuating the backing magnet, moving by electrowetting the liquid droplet with decreased number of magnetically responsive beads away from the specific magnetic conduit. Also disclosed are a method for suspending magnetically responsive beads in liquid portions or droplets in digital microfluidics and a disposable cartridge to carry out the methods.

45 Claims, 2 Drawing Sheets

(52) U.S. Cl.
CPC ... *B01L 3/502761* (2013.01); *B01L 3/502792* (2013.01); *B01L 2200/025* (2013.01); *B01L 2200/0668* (2013.01); *B01L 2300/0816* (2013.01); *B01L 2300/123* (2013.01); *B01L 2400/043* (2013.01); *B01L 2400/0427* (2013.01)

(58) Field of Classification Search
CPC ..... B01L 3/502715; B01L 3/50273; B01L 2400/043; B01L 2400/0427; B01L 2300/123; B01L 2300/0816; B01L 2200/0668; B01L 2200/025
See application file for complete search history.

(56) References Cited

U.S. PATENT DOCUMENTS

| | | | | |
|---|---|---|---|---|
| 7,816,121 | B2 | 10/2010 | Pollack et al. | |
| 7,851,184 | B2 | 12/2010 | Pollack et al. | |
| 8,927,296 | B2 * | 1/2015 | Sista ..... | B01L 3/502761 436/174 |
| 2009/0298059 | A1 | 12/2009 | Gumbrecht | |
| 2010/0279374 | A1 | 11/2010 | Sista et al. | |
| 2013/0017538 | A1 * | 1/2013 | Ionescu-Zanetti ... | C12Q 1/6806 435/6.11 |
| 2013/0126358 | A1 | 5/2013 | Lee et al. | |
| 2013/0134040 | A1 | 5/2013 | Lee et al. | |
| 2013/0175169 | A1 | 7/2013 | Feiglin et al. | |
| 2013/0270114 | A1 | 10/2013 | Feiglin | |
| 2014/0057363 | A9 * | 2/2014 | Sista ..... | B01L 3/502792 436/174 |
| 2014/0190832 | A1 * | 7/2014 | Lay ..... | B01L 9/527 204/601 |

FOREIGN PATENT DOCUMENTS

| | | | | |
|---|---|---|---|---|
| WO | WO-2010132862 | A1 * | 11/2010 | ..... A61K 35/12 |
| WO | 2011002957 | A2 | 1/2011 | |

OTHER PUBLICATIONS

Written Opinion for orresponding PCT application No. PCT/US2015/048141, dated Mar. 9, 2017.

* cited by examiner

MAGNETIC CONDUITS IN MICROFLUIDICS

FIELD OF TECHNOLOGY

The present invention relates to the control and manipulation of liquids in a small volume, usually in the micro- or nanoscale format. In digital microfluidics, a defined voltage is applied to electrodes of an electrode array, so that individual droplets are addressed (electrowetting). For a general overview of the electrowetting method, please see Washizu, IEEE Transactions on Industry Applications, Volume 34, No. 4, 1998, and Pollack et al., *Lab chip,* 2002, Volume 2, 96-101. Briefly, electrowetting refers to a method to move liquid droplets using arrays of microelectrodes, preferably covered by a hydrophobic layer that is used as a working surface. By applying a defined voltage to electrodes of the electrode array, a change of the surface tension of the liquid droplet, which is present on the addressed electrodes, is induced. This results in a remarkable change of the contact angle of the droplet on the addressed electrode, hence in a movement of the droplet. For such electrowetting procedures, two principle ways to arrange the electrodes are known: using one single working surface with an electrode array for inducing the movement of droplets in a monoplanar setup or adding a second surface that is opposite a similar electrode array and that provides at least one ground electrode in a biplanar setup. A major advantage of the electrowetting technology is that only a small volume of liquid is required, e.g. a single droplet. Thus, liquid processing can be carried out within considerably shorter time. Furthermore, the control of the liquid movement can be completely under electronic control resulting in automated processing of samples.

In life science and diagnostic applications, extraction and purification of biomolecules often is done via functionalized magnetically responsive beads (or magnetic beads for short). During extraction, the targeted biomolecules bind specifically to the surface of the beads via chemical moieties. After immobilizing the magnetic beads with a magnetic force, undesirable biomolecules and fluids are removed, usually with a pipette or passing fluid flow. Optimal extractions are defined as ones with a maximum retention of desired biomolecules, and a maximum removal of un-wanted biomolecules; in practice, these requirements translate into maximizing bead retention while minimizing leftover fluid. Many parameters affect the efficiency of extraction and clean-up: the number of binding sites available as determined by the number of magnetic beads and the number of binding sites per bead, the speed with which the beads and binding molecules interact, the avidity with which the beads and captured biomolecules bind to each other, the strength of the magnetic field on the beads, the gradient of that magnetic field and the force with which the wash fluid moves past the magnetic beads.

Electrowetting with magnetic beads is an extremely attractive means by which to run heterogeneous assays that require serial binding and washing steps. Binding is extremely efficient in this microfluidic format as the beads can be mixed while the binding is taking place therefore effectively reducing diffusion distances. Washing is also efficient as most of the liquid can be removed when droplets are pulled away from the beads. A challenge with electrowetting systems that is similar to one with conventional systems is to hold the beads against the interfacial tension of the aqueous droplet and a filler-fluid (which e.g. is oil or air). In order to prevent the magnetic beads from being swept away, it is desirable to have a strong magnetic force that concentrates the beads in a small area to better enable a bead pellet to resist the tendency of the interface to sweep magnetic beads away.

In standard electrowetting devices, it is desirable to put magnets underneath the PCB (=printed circuit board) containing driving electrodes for electrowetting to pull magnetic beads out of a droplet. In film-based electrowetting in which the PCB is part of the instrument and not part of the consumable, one has the luxury of being able to incorporate many features directly into the PCB. This leads to increased PCB layers and therefore to a thicker PCB thickness. An example is an extra layer to accommodate embedded heaters. The amplitude of magnetic fields and gradients strongly depends on the distance between the magnet and the location of interest so a thick PCB reduces the effective magnetic force on the droplets and magnetic beads. A common way to generate strong magnetic fields into an electrowetting system is to use large magnets underneath the PCB.

Such large magnets as positioned below the PCB have several disadvantages:

- they take up considerable space in the instrument,
- magnetic force is reduced at the bead location because it is relatively far away,
- the magnetic gradient is more diffuse,
- location of bead extraction is ill-defined because the magnetic field is spread out,
- magnets must be carefully aligned with the PCB to ensure that the magnetic bead extraction location is compatible with the electrowetting droplet motion.

RELATED PRIOR ART

Automated liquid handling systems are generally well known in the art. An example is the Freedom EVO® robotic workstation from the present applicant (Tecan Schweiz AG, Seestrasse 103, CH-8708 Mannedorf, Switzerland). These automated systems are larger systems that are not designed to be portable and typically require larger volumes of liquids (microliter to milliliter) to process.

A device for liquid droplet manipulation by electrowetting using one single surface with an electrode array (a monoplanar arrangement of electrodes) is known from the U.S. Pat. No. 5,486,337. All electrodes are placed on a surface of a carrier substrate, lowered (embedded) into the substrate, or covered by a non-wettable (i.e. hydrophobic) surface. A voltage source is connected to the electrodes. Droplets are moved by applying a voltage to subsequent electrodes, thus guiding the movement of the liquid droplet above the electrodes according to the sequence of voltage application to the electrodes.

An electrowetting device for microscale control of liquid droplet movements, using an electrode array with an opposing surface with at least one ground electrode is known from U.S. Pat. No. 6,565,727 (a biplanar arrangement of electrodes). Each surface of this device may comprise a plurality of electrodes. The two opposing arrays form a gap. The surfaces of the electrode arrays directed towards the gap are preferably covered by an electrically insulating, hydrophobic layer. The liquid droplet is positioned in the gap and moved within a non-polar filler fluid by consecutively applying a plurality of electric fields to a plurality of electrodes positioned on the opposite sides of the gap.

The use of an electrowetting device for manipulating liquid droplets in the context of the processing of biological samples is known from the international patent application published as WO 2011/002957 A2. There, it is disclosed that a droplet actuator typically includes a bottom substrate with the control electrodes (electrowetting electrodes) insulated by a dielectric, a conductive top substrate, and a hydrophobic coating on the bottom and top substrates. The cartridge may include a ground electrode, which may be replaced or covered by a hydrophobic layer, and an opening for loading samples into the gap of the cartridge. Interface material (e.g. a liquid, glue or grease) may provide adhesion of the cartridge to the electrode array.

Disposable cartridges for microfluidic processing and analysis in an automated system for carrying out molecular diagnostic analysis are disclosed in WO 2006/125767 A1 (see US 2009/0298059 A1 for English translation). The cartridge is configured as a flat chamber device (with about the size of a check card) and can be inserted into the system. A sample can be pipetted into the cartridge through a port and into processing channels.

Droplet actuator structures are known from the international patent application WO 2008/106678. This document particularly refers to various wiring configurations for electrode arrays of droplet actuators, and additionally discloses a two-layered embodiment of such a droplet actuator which comprises a first substrate with a reference electrode array separated by a gap from a second substrate comprising control electrodes. The two substrates are arranged in parallel, thereby forming the gap. The height of the gap may be established by spacer. A hydrophobic coating is in each case disposed on the surfaces which face the gap. The first and second substrate may take the form of a cartridge, eventually comprising the electrode array.

From US 2013/0270114 A1, a digital microfluidics system for manipulating samples in liquid droplets within disposable cartridges is known. The disposable cartridge comprises a bottom layer, a top layer, and a gap between the bottom and top layers. The digital microfluidics system comprises a base unit with at least one cartridge accommodation site that is configured for taking up a disposable cartridge, at least one electrode array comprising a number of individual electrodes and being supported by a bottom substrate, and a central control unit for controlling selection of the individual electrodes of said at least one electrode array and for providing these electrodes with individual voltage pulses for manipulating liquid droplets within said cartridges by electrowetting.

U.S. Pat. No. 7,816,121 B2 and U.S. Pat. No. 7,851,184 B2 disclose a droplet actuation system and corresponding method of its use. The system comprises a substrate with electrowetting electrodes (or PCB), temperature control means for carrying out PCR-based nucleic acid amplification in droplets, means for effecting a magnetic field in proximity to electrowetting electrodes for immobilizing magnetically responsive beads in droplets that are located in a gap on the PCB. The processor, the electrowetting electrodes, and the magnetic field are configured to cause splitting of a droplet comprising magnetically responsive beads. Using the system for splitting droplets yields two daughter droplets, one with magnetically responsive beads and one with substantially reduced amount of beads. Means for effecting a magnetic field may comprise on a side of the gap opposite to the PCB a magnet and means for moving the magnet into and out of proximity with electrowetting electrodes.

U.S. Pat. No. 8,927,296 B2 discloses a method of reducing liquid volume surrounding beads. The method encompasses the steps of providing, in an operations gap of a digital microfluidics system, a droplet that comprises one or more magnetically responsive beads. The method further encompasses exposing these beads in the droplet to a magnetic field of the digital microfluidics system, and separating the droplet from the magnet field by electrowetting. As a result of the method, the magnetically responsive beads remain in the magnetic field and in a sub-droplet atop an electrowetting electrode of the digital microfluidics system.

OBJECTS AND SUMMARY OF THE PRESENT INVENTION

It is an object of the present invention to suggest alternative devices for and/or alternative methods of substantially removing magnetically responsive beads from droplets on a working surface in digital microfluidics. It is another object of the present invention to suggest alternative devices for and/or alternative methods of substantially re-suspending magnetically responsive beads in droplets on a working surface in digital microfluidics.

According to a first aspect, these objects are achieved by the integration of a magnetic conduit into the PCB of a digital microfluidics device. According to a second aspect, these objects are achieved by conducting electrowetting operations and directing the propagation of a magnetic field to the sample of interest using a magnetic conduit in the PCB. Preferred embodiments result in stronger and more localized magnetic forces and gradients for enhanced bead-based extractions and purifications.

Additional and inventive features, preferred embodiments, and variants of the present invention derive from the respective dependent claims.

Advantages of the present invention comprise:

- Provision of a magnetic conduit with a backing magnet results in stronger and more localized magnetic forces directed to magnetically responsive beads in liquid portions or droplets manipulated by digital microfluidics.
- Provision of a magnetic conduit with a backing magnet results in steeper gradients of magnetic forces for enhanced bead-based extractions and purifications in liquid portions or droplets manipulated by digital microfluidics.
- The location of the magnetic conduit within the PCB enables a precise positioning of the immobilized beads on the top surface of a working film or PCB.
- There is no need of careful alignment of the backing magnet and the magnetic conduit, because only the magnetic conduit is defining the site of attraction for magnetically responsive beads.
- Magnetic conduits can be located in a first substrate or PCB and/or in a second substrate that encloses a gap with the PCB.
- Magnetic conduits can be located below and/or above any position reachable by at least a part of liquid portions or droplets when manipulated by digital microfluidics.
- Combinations of magnetic conduits and movable permanent magnets enable switching on/off the magnetic fields as required.
- Combinations of magnetic conduits and switchable permanent magnets enable switching on/off the magnetic fields with minimal or even without moving parts.
- Combinations of magnetic conduits and electromagnets enable switching on/off the magnetic fields without moving parts.

BRIEF INTRODUCTION OF THE DRAWINGS

Figure 2:
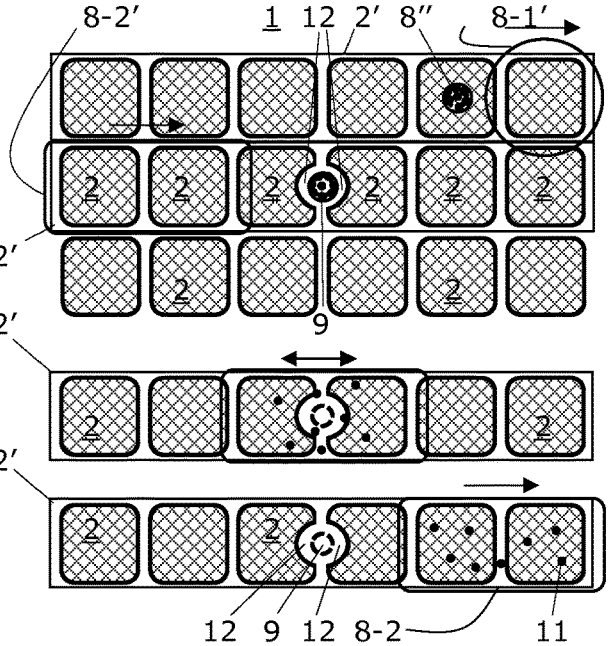
Figure 3:
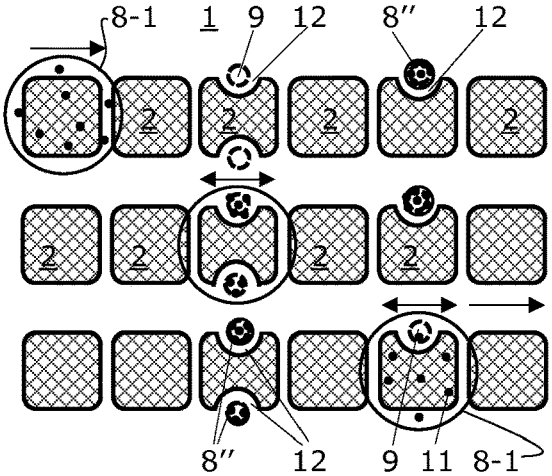
Figure 4:
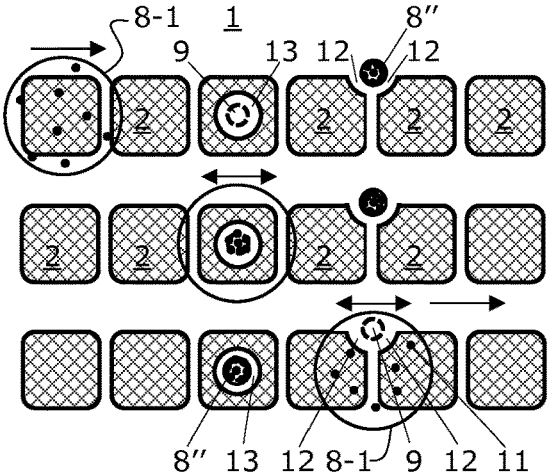
Figure 5:
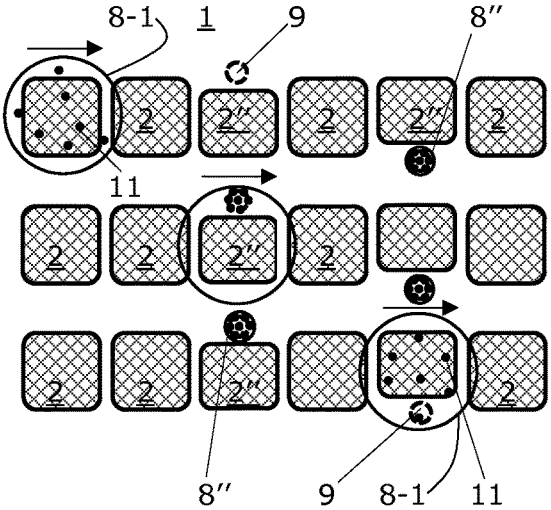
Figure 6:
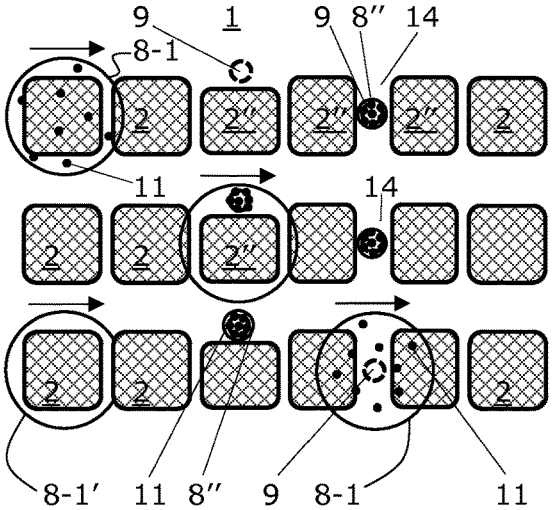
Figure 7:
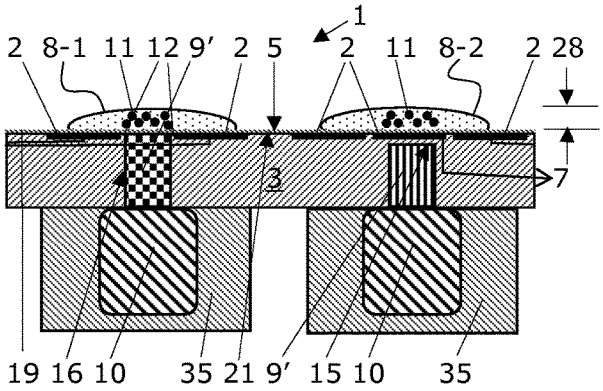
Figure 8:
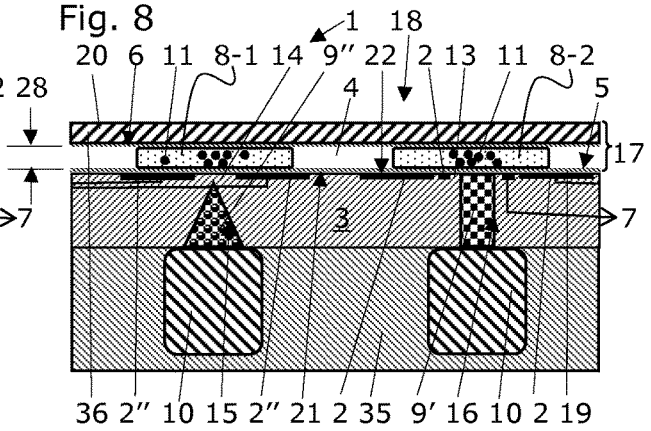
Figure 9:
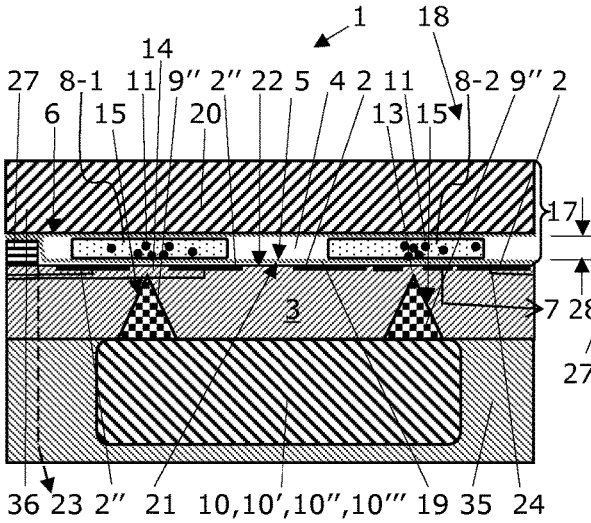
Figure 10:
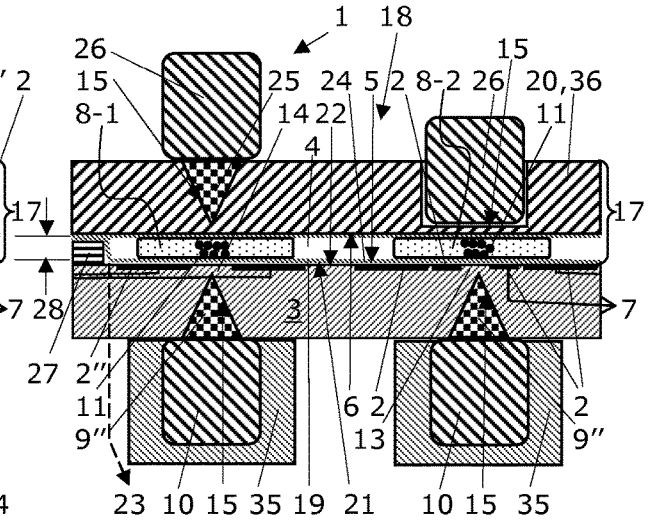
Figure 11:
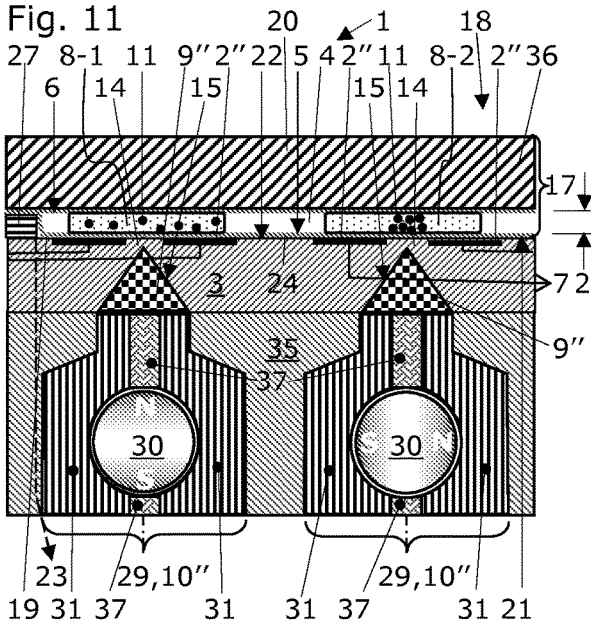
Figure 12:
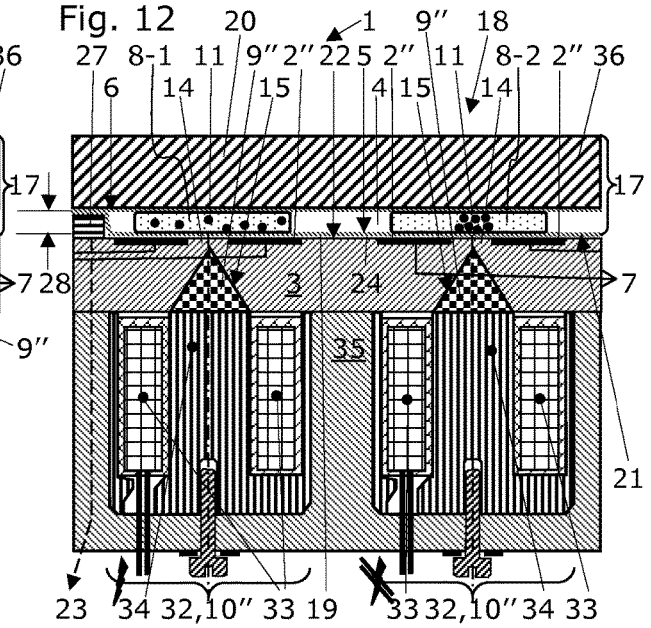

Integration of magnetic conduits into the PCB or first substrate and/or second substrate according to the present invention is described with the help of the attached schematic drawings that show selected and exemplary embodiments of the present invention without narrowing the scope and gist of this invention. It is shown in:

FIG. 1 a plane view of an array or number of electrodes; two single magnetic conduits are located in the paths of two small droplets, a first magnetic conduit is located below the center of an electrowetting electrode, and a second magnetic conduit is located in neighboring notches in-between two of the electrowetting electrodes that in each case define the path;

FIG. 2 a plane view of an array or number of electrodes; two single magnetic conduits are located in the path of a larger drop or of a small droplet, a first magnetic conduit is located below the center of an electrowetting electrode, and a second magnetic conduit is located in neighboring notches in-between two of the electrowetting electrodes that in each case define the path;

FIG. 3 a plane view of three magnetic conduits located in the path of a droplet; a pair of these magnetic conduits are located in notches at opposite sides of one electrode and a single magnetic conduit being located in a notch at one side of another electrode of the electrowetting electrodes that define this path;

FIG. 4 a plane view of the path of a droplet; one magnetic conduit is located in a central void of one electrode and one magnetic conduit is located in neighboring notches at the corners of two other electrodes of the electrowetting electrodes that define this path;

FIG. 5 a plane view of two magnetic conduits localized in the path of a droplet; one magnetic conduit is located at a side of one narrowed electrode and one magnetic conduit being located at an opposite side of another narrowed electrode of the electrowetting electrodes that define this path;

FIG. 6 a plane view of two magnetic conduits located in the path of a droplet, one magnetic conduit being located at a side of one narrowed electrode and one magnetic conduit being located in a space between two other narrowed electrowetting electrodes that define this path;

FIG. 7 a monoplanar setup in a cross section view with two cylindrical, cuboid magnetic conduits located in a PCB or first substrate and backed with individual backing magnets; one magnetic conduit being located in a through hole between neighboring notches in-between two electrodes and one magnetic conduit being located in a blind hole below the center of an electrode;

FIG. 8 a biplanar setup in a cross section view with one cylindrical, cuboid magnetic conduit and of one conical, pyramidal magnetic conduit located in a PCB or first substrate and backed with individual backing magnets; one magnetic conduit being located in a blind hole below a space between two narrowed electrodes, one in a through hole in a central void of an electrode;

FIG. 9 a biplanar setup in a cross section view with two conical, pyramidal magnetic conduits located in a PCB or first substrate and backed by a single, large backing magnet; both magnetic conduits being located in a blind hole, one below a space between two narrowed electrodes and one below a central void of an electrode;

FIG. 10 a biplanar setup in a cross section view with two conical, pyramidal magnetic conduits in the PCB, each backed with a backing magnet; in blind holes of a cover-plate of a cartridge accommodated on the PCB (i.e. in a second substrate), there is aligned with one of these magnetic conduits in the PCB and backed with an individual magnet a conical, pyramidal magnetic conduit, and there is aligned a magnet with the other magnetic conduit in the PCB or first substrate;

FIG. 11 a biplanar setup in a cross section view with two conical, pyramidal magnetic conduits located in blind holes of a PCB or first substrate, each magnetic conduit being backed by an individual switchable permanent magnet configured as a magnetic base; the left switchable permanent magnet being turned "OFF" and the right switchable permanent magnet being turned "ON";

FIG. 12 a biplanar setup in a cross section view with two conical, pyramidal magnetic conduits located in blind holes of a PCB or first substrate, each magnetic conduit being backed by an individual switchable permanent magnet configured as a PE-magnet; the left PE-magnet being turned "OFF" and the right PE-magnet being turned "ON".

DETAILED DESCRIPTION OF THE PRESENT INVENTION

The inventive magnetic conduits with backing magnets and their use is now described in detail. FIG. 1 shows a plane view of an array or number of electrodes 2 of a digital microfluidics system 1 configured for substantially removing or suspending magnetically responsive beads from or in liquid portions 8-2 or liquid droplets 8-1. Two single magnetic conduits 9 are located in the paths of two liquid droplets 8-1; a first magnetic conduit is located below the center of an electrowetting electrode 2, and a second magnetic conduit is located in neighboring notches 12 in-between of two of the electrowetting electrodes that in each case define the path of selected electrodes 2'.

FIG. 2 shows a plane view of an array or number of electrodes 2 of a digital microfluidics system 1 configured for substantially removing or suspending magnetically responsive beads from or in liquid portions 8-2 or liquid droplets 8-1. A single magnetic conduit 9 is located in the path of a larger drop or liquid portion 8-2 and another single magnetic conduit 9 is located in the path of a liquid droplet 8-1. A first magnetic conduit 9 is located below the center of an electrowetting electrode 2, and a second magnetic conduit 9 is located in neighboring notches 12 in-between of two of the electrowetting electrodes 2 that in each case define the path of selected electrodes 2'.

In both FIGS. 1 and 2, all paths of selected electrodes 2' are expressly indicated, because there also are visible electrodes 2 of the electrode array, which are not selected as defining such a path. In the context of the present invention, an electrode array is a regular arrangement of electrodes, e.g. in an orthogonal lattice as indicated in the FIGS. 1 and 2 or in any other regular arrangement such as a linear or hexagonal array.

The digital microfluidics system 1 comprises a number or array of individual electrodes 2 attached to a first substrate 3 or PCB. A first hydrophobic surface 5 is located on said individual electrodes 2. This first hydrophobic surface 5 may belong to the digital microfluidics system 1 or to a disposable cartridge 17 that is accommodated at a cartridge accommodation site 18 of the digital microfluidics system 1. A central control unit 7 of the digital microfluidics system 1 is in operative contact with said individual electrodes 2 for controlling selection and for providing a number of said individual electrodes 2 that define a path of individual electrodes 2) with voltage for manipulating liquid portions 8-2 or liquid droplets 8-1 by electrowetting.

According to the present invention, in the first substrate 3 of the microfluidics system 1 and below said individual electrodes 2 there is located at least one magnetic conduit 9 that is configured to be backed by a backing magnet 10. The term "below" is to be understood in the context of the present invention as "on the back-side of the PCB to which's front-side the electrodes 2 are attached, no matter what spatial orientation the PCB may have. Further according to the present invention, said at least one magnetic conduit 9 is located in close proximity to individual electrodes 2 (see FIGS. 7-12 as described below).

Particularly referring to FIG. 1 and on the one hand, there is depicted on the uppermost path of selected electrodes 2' a liquid droplet 8-1 containing dispersed magnetically responsive beads. This liquid droplet 8-1 is moving to the right by electrowetting (see arrow beside the droplet). Below the electrode 2 that (when viewing in direction of the droplet movement) is located next to the electrode 2 the liquid droplet 8-1 actually is residing on, there is located a magnetic conduit 9 according to the invention. It is preferred that this at least one specific magnetic conduit 9 consists of a single solid ferromagnetic element, or of a multitude of randomly orientated ferromagnetic elements, or of an amorphous paste filled with ferromagnetic material. As shown, this at least one specific magnetic conduit 9 is located under and is covered by an individual electrode 2.

Particularly referring to FIG. 1 and on the other hand, there is depicted on the second uppermost path of selected electrodes 2' a liquid droplet 8-1 containing dispersed magnetically responsive beads. This liquid droplet 8-1 is moving to the right by electrowetting (see arrow beside the droplet). Between the electrode 2 that (when viewing in direction of the droplet movement) is located next to the electrode 2 the droplet actually is residing on and the next electrode 2, there is located a magnetic conduit 9 according to the invention. It is preferred that this at least one specific magnetic conduit 9 consists of a single solid ferromagnetic element, or of a multitude of randomly orientated ferromagnetic elements, or of an amorphous paste filled with ferromagnetic material. As shown, this at least one specific magnetic conduit 9 is located beside of and is not covered by at least one individual electrode 2. To be more precise, said at least one magnetic conduit 9 is located in neighboring notches 12 in-between of two of the individual electrodes 2 that define this path of selected electrodes 2'.

The third uppermost path of selected electrodes 2' in the electrode array of FIG. 1 is not active here and thus void of any liquid droplets and magnetic conduits. Below this array of 3×6 electrodes, there is twice redrawn the second uppermost path of selected electrodes 2', but showing two consecutive situations in a method of substantially removing magnetically responsive beads from liquid droplets 8-1 in digital microfluidics. This removing method according to the invention comprises the steps of:

a) providing a digital microfluidics system 1 comprising a number or array of individual electrodes 2 attached to a first substrate 3, a first hydrophobic surface 5 located on said individual electrodes 2, and a central control unit 7 in operative contact with said individual electrodes 2 for controlling selection and for providing a number of said individual electrodes 2 with voltage for manipulating liquid portions 8-2 or liquid droplets 8-1 by electrowetting;

b) providing in the first substrate 3 of the microfluidics system 1 and below said individual electrodes 2 at least one magnetic conduit 9 comprising a backside and being configured to be backed by a backing magnet 10 with a magnetic field and being configured for directing said magnetic field through the magnetic conduit 9 to the first hydrophobic surface 5 on said individual electrodes 2, said at least one magnetic conduit 9 being located in close proximity to individual electrodes 2;

c) providing on the hydrophobic surface 5 and above a path of selected electrodes 2' at least one liquid portion 8-2 or liquid droplet 8-1 that comprises magnetically responsive beads 11;

d) moving by electrowetting said at least one liquid portion 8-2 or liquid droplet 8-1 with the magnetically responsive beads 11 on said path of selected electrodes 2' until at least a part of said at least one liquid portion 8-2 or liquid droplet 8-1 is placed atop of at least one specific magnetic conduit 9;

e) actuating the backing magnet 10 so that it is operatively backing the at least one specific magnetic conduit 9, and thus attracting magnetically responsive beads 11 of said at least one liquid portion 8-2 or liquid droplet 8-1 through directing said magnetic field to the first hydrophobic surface 5 on said individual electrodes 2 by the at least one specific magnetic conduit 9 and concentrating attracted magnetically responsive beads 11; and f) while actuating the backing magnet 10, moving by electrowetting said at least one liquid portion 8-2' or liquid droplet 8-1' with a substantially decreased number of magnetically responsive beads 11 on said path of selected electrodes 2 away from the specific magnetic conduit 9.

Thus, a small liquid portion 8" with magnetically responsive beads 11 may be separated from said at least one liquid portion 8-2 or liquid droplet 8-1.

It is necessary to point out here that the steps d) and e) (depicted in the second lowest path of selected electrodes 2' of FIG. 1) may be interchanged without compromising the result. The double arrow indicates that it is possible and often preferred during actuating the backing magnet 10 according to step e), that said at least one liquid portion 8-2 or liquid droplet 8-1 with the magnetically responsive beads 11 is moved to and fro on said path of individual electrodes 2' by electrowetting in order to support attraction of the magnetically responsive beads 11 by the specific magnetic conduit 9.

The step f) is depicted in the lowest path of selected electrodes 2' of FIG. 1 showing the result of the removing method: a liquid droplet 8-1' moving on the path of individual electrodes 2' by electrowetting (see arrow) substantially without magnetically responsive beads 11 and a small liquid portion 8" together with substantially all magnetically responsive beads 11 residing on top of the specific magnetic conduit 9.

Particularly referring to FIG. 2 on the one hand, there is depicted on the uppermost path of selected electrodes 2' a liquid droplet 8-1' without magnetically responsive beads. This liquid droplet 8-1' is moving to the right by electrowetting (see arrow beside the droplet). Below the electrode 2 that (when viewing in direction opposite to the droplet movement) is located next to the electrode 2 the liquid droplet 8-1' actually is residing on, there is located a magnetic conduit 9 according to the invention. It is preferred that this at least one specific magnetic conduit 9 consists of a single solid ferromagnetic element, or of a multitude of randomly orientated ferromagnetic elements, or of an amorphous paste filled with ferromagnetic material. As shown, this at least one specific magnetic conduit 9 is located under and is covered by an individual electrode 2. Again, the step f) of the removing method according to the invention is depicted in the uppermost path of selected electrodes 2' of FIG. 2 showing the result of the separation: a liquid droplet 8-1' moving on the path of individual electrodes 2' by electrowetting (see arrow) substantially without magnetically responsive beads 11 and a small liquid portion 8" together with substantially all magnetically responsive beads 11 residing on-top of the specific magnetic conduit 9.

Particularly referring to FIG. 2 on the other hand, there is depicted on the second uppermost path of selected electrodes 2' a liquid portion 8-2' without magnetically responsive beads. This liquid portion 8-2' is moving to the right by electrowetting (see arrow beside the droplet). Between the electrode 2 that (when viewing in direction of the liquid portion movement) is located next to the electrodes 2 the liquid portion actually is residing on and the next electrode 2, there is located a magnetic conduit 9 according to the invention. It is preferred that this at least one specific magnetic conduit 9 consists of a single solid ferromagnetic element, or of a multitude of randomly orientated ferromagnetic elements, or of an amorphous paste filled with ferromagnetic material. As shown, this at least one specific magnetic conduit 9 is located beside of and is not covered by at least one individual electrode 2. To be more precise, said at least one magnetic conduit 9 is located in neighboring notches 12 in-between of two of the individual electrodes 2 that define this path of selected electrodes 2'. As a result of a previously applied removing method (see FIG. 1) is depicted a small liquid portion 8" together with substantially all magnetically responsive beads 11 residing on top of the specific magnetic conduit 9.

The third uppermost path of selected electrodes 2' in the electrode array of FIG. 2 is not active here and thus void of any droplets and magnetic conduits. Below this array of 3×6 electrodes, there is twice redrawn the second uppermost path of selected electrodes 2', but showing two consecutive situations in a method of substantially suspending magnetically responsive beads in liquid portions 8-2 or liquid droplets 8-1 in digital microfluidics:

This suspending method according to the invention comprises the steps of:

a) providing a digital microfluidics system 1 comprising a number or array of individual electrodes 2 attached to a first substrate 3, a first hydrophobic surface 5 located on said individual electrodes 2, and a central control unit 7 in operative contact with said individual electrodes 2 for controlling selection and for providing a number of said individual electrodes 2 with voltage for manipulating liquid portions 8-2 or liquid droplets 8-1 by electrowetting;

b) providing in the first substrate 3 of the microfluidics system 1 and below said individual electrodes 2 at least one magnetic conduit 9 comprising a backside and being configured to be backed by a backing magnet 10 with a magnetic field and being configured for directing said magnetic field through the magnetic conduit 9 to the first hydrophobic surface 5 on said individual electrodes 2, said at least one magnetic conduit 9 being located in close proximity to individual electrodes 2;

c) providing on the hydrophobic surface 5 and above a path of selected electrodes 2' at least one liquid portion 8-2' or liquid droplet 8-1' that lacks magnetically responsive beads 11;

d) moving by electrowetting said at least one liquid portion 8-2' or liquid droplet 8-1' without magnetically responsive beads 11 on said path of selected electrodes 2' until at least a part of said at least one liquid portion 8-2' or liquid droplet 8-1' is placed atop of a specific magnetic conduit 9;

e) de-actuating the backing magnet 10 that is operatively backing the specific magnetic conduit 9, and thus releasing magnetically responsive beads 11 that previously had been separated from at least one liquid portion 8-2' or liquid droplet 8-1' by the specific magnetic conduit 9 into said at least one liquid portion 8-2' or liquid droplet 8-1'; and f) while de-actuating the backing magnet 10, moving by electrowetting said at least one liquid portion 8-2 or liquid droplet 8-1 with a substantial number of suspended magnetically responsive beads 11 on said path of individual electrodes 2' away from the specific magnetic conduit 9, thus merging the magnetically responsive beads 11 with said at least one liquid portion 8-2' or liquid droplet 8-1'.

It is necessary to point out here that the steps d) and e) (depicted in the second lowest path of selected electrodes 2' of FIG. 2) may be interchanged without compromising the result. The double arrow indicates that it is possible and often preferred during de-actuating the backing magnet 10 according to step e), that said at least one liquid portion 8-2 with the magnetically responsive beads 11 is moved to and fro on said path of individual electrodes 2' by electrowetting in order to support suspension of the magnetically responsive beads 11 in the liquid portion 8-2' or liquid droplet 8-1'.

The step f) is depicted in the lowest path of selected electrodes 2' of FIG. 2 showing the result of the suspending method: while de-actuating the backing magnet 10, moving by electrowetting said at least one liquid portion 8-2 or liquid droplet 8-1 with a substantial number of suspended magnetically responsive beads 11 on said path of individual electrodes 2' away from the specific magnetic conduit 9. Thus the small liquid portion 8" with the magnetically responsive beads 11 is merged with said at least one liquid portion 8-2' or liquid droplet 8-1' without magnetically responsive beads 11.

In the context of the present invention, a liquid droplet 8-1,8-1' has a size that covers on the hydrophobic surface 5 an area that is larger than a single individual electrode 2. Thus, a liquid droplet 8-1,8-1' is the smallest liquid volume that may be manipulated (i.e. transported) by electrowetting. In the context of the present invention, a liquid portion 8-2,8-2' has a size that covers on the hydrophobic surface 5 an area that is larger than two adjacent individual electrodes 2. Thus, a liquid portion 8-2,8-2' is larger than the smallest liquid volume that may be manipulated (i.e. transported) by electrowetting.

FIG. 3 shows a plane view of three magnetic conduits 9 located in the path of a droplet. A pair of these magnetic conduits 9 are located in notches 12 at opposite sides of one individual electrode 2 and a single magnetic conduit 9 is located in a notch 12 at one side of another individual electrode 2 of the selected electrowetting electrodes that define this path 2'. Three situations of the same droplet path 2' are depicted in FIG. 3:

In the upper situation, a liquid droplet 8-1 with magnetically responsive beads 11 (dispersed in the droplet) is being moved to the right by electrowetting (indicated by arrow). The third individual electrode 2 of the electrode path 2' (when counted from the left) comprises two magnetic conduits 9 that are located in two notches 12 at opposite sides of the individual electrode 2 that also defines this path of selected electrodes 2'. On these two magnetic conduits 9, there actually are no magnetically responsive beads located. The fifth individual electrode 2 of the electrode path 2' (when counted from the left) comprises one magnetic conduit 9 that is located in a notch 12 at one side of this individual electrode 2 that define this path of selected electrodes 2'. On this single magnetic conduit 9, there actually are located magnetically responsive beads 11 that have been brought to this place in a previous droplet manipulation by electrowetting. The backing magnet 10 of this single magnetic conduit 9 may be in its activated state or not at this time.

In the middle situation, the same liquid droplet 8-1 with magnetically responsive beads 11 is located on the one individual electrode 2 that has the two notches 12 at opposite sides and also on the sides of the selected electrowetting electrodes that define this path 2'. The backing magnet(s) 10 on the backside of the magnetic conduits 9 is/are now in the activated state, so that in each case the backing magnet(s) is/are operatively backing these two specific magnetic conduits 9. Thus, the magnetically responsive beads 11 of the liquid droplet 8-1 are attracted through directing the magnetic fields of the two magnetic conduits 9 to the first hydrophobic surface 5 on the individual electrode 2 by the two specific magnetic conduits 9. Also by the influence of the two magnetic conduits 9, most or all of the attracted magnetically responsive beads 11 are concentrated on-top of the two specific magnetic conduits 9. In order to additionally support attraction of the magnetically responsive beads 11 by the specific magnetic conduits 9, it may be preferred to move the liquid droplet 8-1 with the magnetically responsive beads 11 to and fro on said path of individual electrodes 2' by electrowetting (indicated by double arrow).

In the lower situation, while actuating the backing magnet(s) 10 of the two specific magnetic conduits 9, the liquid droplet 8-1' now with a substantially decreased number of magnetically responsive beads 11 is moved on the path of selected electrodes 2 away from the specific magnetic conduits 9 by electrowetting. Thus, most or all of the magnetically responsive beads 11 are separated from the liquid droplet 8-1' potentially together with a very small liquid portion (not shown here; compare with the lowest path of selected electrodes 2' of FIG. 1). The liquid droplet 8-1' now substantially without magnetically responsive beads 11 is moved to the fifth individual electrode 2 of the electrode path 2' that comprises one magnetic conduit 9 that is located in a notch 12 at one side of this individual electrode 2 that define this path of selected electrodes 2'. At this point at the latest, the backing magnet 10 of this single magnetic conduit 9 may be de-activated and thus the magnetically responsive beads 11 may be released to disperse within the liquid droplet 8-1'. In order to support releasing the magnetically responsive beads 11 from the specific magnetic conduit 9 and suspending the magnetically responsive beads 11 in the liquid droplet 8-1' during de-actuating the backing magnet 10, the liquid droplet 8-1' without magnetically responsive beads 11 may be moved to and fro on said path of individual electrodes 2' by electrowetting (see double arrow). While de-actuating the backing magnet 10, the liquid droplet 8-1 with a substantial number of suspended magnetically responsive beads 11 is moved by electrowetting on the path of individual electrodes 2' away from the specific magnetic conduit 9 (not shown here but indicated by the arrow, compare with the lowest path of selected electrodes 2' of FIG. 2).

FIG. 4 shows a plane view of the path 2' of a droplet. One magnetic conduit 9 is located in a central void 13 of one individual electrode 2 and one magnetic conduit 9 is located in neighboring notches 12 at the corners of two other individual electrodes 2 of the electrowetting electrodes that define this path 2'. Three situations of the same droplet path 2' are depicted in FIG. 4:

In the upper situation, a liquid droplet 8-1 with magnetically responsive beads 11 (dispersed in the droplet) is being moved to the right by electrowetting (indicated by arrow). The third individual electrode 2 of the electrode path 2' (when counted from the left) comprises one magnetic conduit 9 that is located in a central void 13 of this individual electrode 2 that also defines this path of selected electrodes 2'. On this magnetic conduit 9, there actually are no magnetically responsive beads located. At a corner of the fourth and fifth individual electrode 2 of the electrode path 2' (when counted from the left) there is located one magnetic conduit 9. On this single magnetic conduit 9, there actually are located magnetically responsive beads 11 that have been brought to this place in a previous droplet manipulation by electrowetting. The backing magnet 10 of this single magnetic conduit 9 may be in its activated state or not at this time.

In the middle situation, the same liquid droplet 8-1 with magnetically responsive beads 11 is located on the one individual electrode 2 that has the one magnetic conduit 9 located in a central void 13. The backing magnet 10 on the backside of the magnetic conduit 9 is now in the activated state, so that it is operatively backing this specific magnetic conduit 9. Thus, the magnetically responsive beads 11 of the liquid droplet 8-1 are attracted through directing the magnetic field of the one magnetic conduit 9 to the first hydrophobic surface 5 on the individual electrode 2 by the specific magnetic conduit 9. Also by the influence of the magnetic conduit 9, most or all of the attracted magnetically responsive beads 11 are concentrated on-top of the specific magnetic conduit 9. In order to additionally support attraction of the magnetically responsive beads 11 by the specific magnetic conduit 9, it may be preferred to move the liquid droplet 8-1 with the magnetically responsive beads 11 to and fro on said path of individual electrodes 2' by electrowetting (indicated by double arrow).

In the lower situation, while actuating the backing magnet 10 of the one specific magnetic conduit 9, the liquid droplet 8-1' now with a substantially decreased number of magnetically responsive beads 11 is moved on the path of selected electrodes 2 away from the specific magnetic conduit 9 by electrowetting. Thus, most or all of the magnetically responsive beads 11 are separated from the liquid droplet 8-1' potentially together with a very small liquid portion (not shown here; compare with the lowest path of selected electrodes 2' of FIG. 1). The liquid droplet 8-1' now substantially without magnetically responsive beads 11 is moved to the fourth and fifth individual electrode 2 of the electrode path 2' that comprise one magnetic conduit 9 that is located in a corner of these two individual electrodes 2 that define this path of selected electrodes 2'. At this point at the latest, the backing magnet 10 of this single magnetic conduit 9 may be de-activated and thus the magnetically responsive beads 11 may be released to disperse within the liquid droplet 8-1'. In order to support releasing the magnetically responsive beads 11 from the specific magnetic conduit 9 and suspending the magnetically responsive beads 11 in the liquid droplet 8-1' during de-actuating the backing magnet 10, the liquid droplet 8-1' without magnetically responsive beads 11 may be moved to and fro on said path of individual electrodes 2' by electrowetting (see double arrow). While de-actuating the backing magnet 10, the liquid droplet 8-1 with a substantial number of suspended magnetically responsive beads 11 is moved by electrowetting on the path of individual electrodes 2' away from the specific magnetic conduit 9 (not shown here but indicated by the arrow, compare with the lowest path of selected electrodes 2' of FIG. 2).

FIG. 5 shows a plane view of two magnetic conduits 9 localized in the path of a droplet 2'. One magnetic conduit 9 is located at a side of one narrowed individual electrode 2" and one magnetic conduit 9 is located at an opposite side of another narrowed individual electrode 2" of the electrowetting electrodes that define this path 2'. Three situations of the same droplet path 2' are depicted in FIG. 5:

In the upper situation, a liquid droplet 8-1 with magnetically responsive beads 11 (dispersed in the droplet) is being moved to the right by electrowetting (indicated by arrow). The third individual electrode 2" of the electrode path 2' (when counted from the left) comprises one magnetic conduit 9 that is located on one side of this individual electrode 2 that also defines this path of selected electrodes 2' and also on one side of this electrode path 2'. On this magnetic conduit 9, there actually are no magnetically responsive beads located. At a side of the fifth individual electrode 2" of the electrode path 2' (when counted from the left) and also on one side of this electrode path 2', there is located another magnetic conduit 9. On this single magnetic conduit 9, there actually are located magnetically responsive beads 11 that have been brought to this place in a previous droplet manipulation by electrowetting. The backing magnet 10 of this single magnetic conduit 9 may be in its activated state or not at this time.

In the middle situation, the same liquid droplet 8-1 with magnetically responsive beads 11 is located on the one narrowed individual electrode 2" that has the one magnetic conduit 9 located on its side. The backing magnet 10 on the backside of the magnetic conduit 9 is now in the activated state, so that it is operatively backing this specific magnetic conduit 9. Thus, the magnetically responsive beads 11 of the liquid droplet 8-1 are attracted through directing the magnetic field of the one magnetic conduit 9 to the first hydrophobic surface 5 on the individual electrode 2 by the specific magnetic conduit 9. Also by the influence of the magnetic conduit 9, most or all of the attracted magnetically responsive beads 11 are concentrated on-top of the specific magnetic conduit 9. In order to additionally support attraction of the magnetically responsive beads 11 by the specific magnetic conduit 9, it may be preferred to move the liquid droplet 8-1 with the magnetically responsive beads 11 to and fro on said path of individual electrodes 2' by electrowetting.

In the lower situation, while actuating the backing magnet 10 of the one specific magnetic conduit 9, the liquid droplet 8-1' now with a substantially decreased number of magnetically responsive beads 11 is moved on the path of selected electrodes 2 away from the specific magnetic conduit 9 by electrowetting. Thus, most or all of the magnetically responsive beads 11 are separated from the liquid droplet 8-1' potentially together with a very small liquid portion (not shown here; compare with the lowest path of selected electrodes 2' of FIG. 1). The liquid droplet 8-1' now substantially without magnetically responsive beads 11 is moved to the fifth and narrowed individual electrode 2" of the electrode path 2' that comprises one magnetic conduit 9 on one side and on a side of this path of selected electrodes 2'. At this point at the latest, the backing magnet 10 of this single magnetic conduit 9 may be de-activated and thus the magnetically responsive beads 11 may be released to disperse within the liquid droplet 8-1'. In order to support releasing the magnetically responsive beads 11 from the specific magnetic conduit 9 and suspending the magnetically responsive beads 11 in the liquid droplet 8-1' during de-actuating the backing magnet 10, the liquid droplet 8-1' without magnetically responsive beads 11 may be moved to and fro on said path of individual electrodes 2' by electrowetting. While de-actuating the backing magnet 10, the liquid droplet 8-1 with a substantial number of suspended magnetically responsive beads 11 is moved by electrowetting on the path of individual electrodes 2' away from the specific magnetic conduit 9 (not shown here but indicated by the arrow, compare with the lowest path of selected electrodes 2' of FIG. 2).

FIG. 6 shows a plane view of two magnetic conduits 9 located in the path of a droplet 2'. One magnetic conduit 9 is located at a side of one narrowed electrode 2" and one magnetic conduit is located in a space 14 between two other narrowed electrodes 2" of the electrowetting electrodes that define this path 2'. Three situations of the same droplet path 2' are depicted in FIG. 6:

In the upper situation, a liquid droplet 8-1 with magnetically responsive beads 11 (dispersed in the droplet) is being moved to the right by electrowetting (indicated by arrow). The third individual electrode 2" of the electrode path 2' (when counted from the left) comprises one magnetic conduit 9 that is located on one side of this individual electrode 2 that also defines this path of selected electrodes 2' and also on one side of this electrode path 2'. On this magnetic conduit 9, there actually are no magnetically responsive beads located. In a space 14 between the fourth and fifth individual narrowed electrodes 2" of the electrode path 2' (when counted from the left), there is located another magnetic conduit 9. On this single magnetic conduit 9, there actually are located magnetically responsive beads 11 that have been brought to this place in a previous droplet manipulation by electrowetting. The backing magnet 10 of this single magnetic conduit 9 may be in its activated state or not at this time.

In the middle situation, the same liquid droplet 8-1 with magnetically responsive beads 11 is located on the one narrowed individual electrode 2" that has the one magnetic conduit 9 located on its side. The backing magnet 10 on the backside of the magnetic conduit 9 is now in the activated state, so that it is operatively backing this specific magnetic conduit 9. Thus, the magnetically responsive beads 11 of the liquid droplet 8-1 are attracted through directing the magnetic field of the one magnetic conduit 9 to the first hydrophobic surface 5 on the individual electrode 2 by the specific magnetic conduit 9. Also by the influence of the magnetic conduit 9, most or all of the attracted magnetically responsive beads 11 are concentrated on-top of the specific magnetic conduit 9. In order to additionally support attraction of the magnetically responsive beads 11 by the specific magnetic conduit 9, it may be preferred to move the liquid droplet 8-1 with the magnetically responsive beads 11 to and fro on said path of individual electrodes 2' by electrowetting.

In the lower situation, a liquid droplet 8-1' without magnetically responsive beads 11 is being moved to the right by electrowetting (indicated by arrow). While actuating the backing magnet 10 of the one specific magnetic conduit 9, the liquid droplet 8-1' now with a substantially decreased number of magnetically responsive beads 11 is moved on the path of selected electrodes 2 away from the specific magnetic conduit 9 by electrowetting. Thus, most or all of the magnetically responsive beads 11 are separated from the liquid droplet 8-1' potentially together with a very small liquid portion (not shown here; compare with the lowest path of selected electrodes 2' of FIG. 1). The liquid droplet 8-1' now substantially without magnetically responsive beads 11 is moved to the fourth and fifth narrowed individual electrodes 2" of the electrode path 2' that comprise one magnetic conduit 9 in the space 14 between them. At this point at the latest, the backing magnet 10 of this single magnetic conduit 9 may be de-activated and thus the magnetically responsive beads 11 may be released to disperse within the liquid droplet 8-1'. In order to support releasing the magnetically responsive beads 11 from the specific magnetic conduit 9 and suspending the magnetically responsive beads 11 in the liquid droplet 8-1' during de-actuating the backing magnet 10, the liquid droplet 8-1' without magnetically responsive beads 11 may be moved to and fro on said path of individual electrodes 2' by electrowetting. While de-actuating the backing magnet 10, the liquid droplet 8-1 with a substantial number of suspended magnetically responsive beads 11 is moved by electrowetting on the path of individual electrodes 2' away from the specific magnetic conduit 9 (not shown here but indicated by the arrow, compare with the lowest path of selected electrodes 2' of FIG. 2).

It is evident from this description that the liquid droplets 8-1,8-1' or liquid portions 8-2,8-2' with or without magnetically responsive beads 11 in each case may also be moved from the right to the left of the shown electrode paths 2'. It is further evident from this description that such movements can also be directed in any other direction of an electrode array. Moreover, inverse movements and inverse actions on the removal of magnetically responsive beads 11 from liquid droplets 8-1 or liquid portions 8-2 as well as on the suspension of magnetically responsive beads 11 within liquid droplets 8-1' or liquid portions 8-2' are disclosed and evident from the present description and drawings.

FIG. 7 shows a monoplanar setup of a digital microfluidics system 1 in a cross section view. This digital microfluidics system 1 is configured for substantially removing or suspending magnetically responsive beads 11 from or in liquid portions 8-2 or liquid droplets 8-1. The digital microfluidics system 1 comprises a number or an array of individual electrodes 2 that are attached to a first substrate or PCB 3. A first hydrophobic surface 5 (preferably but not exclusively as a part of a working film 19) is located on the individual electrodes 2. A working film 19 laid on-top of the electrodes 2 of the PCB 3 abuts with its backside 21 the surface of the PCB. A central control unit 7 is in operative contact with the individual electrodes 2 (see contact lines drawn in the first substrate) for controlling selection and for providing a number of individual electrodes 2 that define a path of individual electrodes 2' (see FIGS. 1 and 2) with voltage for manipulating liquid portions 8-2 or liquid droplets 8-1 by electrowetting. As depicted, two cylindrical, cuboid magnetic conduits 9' are located in the PCB or first substrate 3. Both cuboid magnetic conduits 9' are backed with an individual backing magnet 10 that is held by an individual support 35 in each case.

The left magnetic conduit 9' is located in a through hole 16 between neighboring notches 12 in-between of two electrodes 2. Thus, said at least one specific magnetic conduit 9 is located beside of and is not covered by at least one individual electrode 2. The right magnetic conduit 9' is located in a blind hole 15 below the center of an electrode 2. Thus, said at least one specific magnetic conduit 9 is located under and is covered by an individual electrode 2.

As shown, in the first substrate 3 of the microfluidics system 1 and below the individual electrodes 2 there is located at least one magnetic conduit 9 that is configured to be backed by a backing magnet 10, said at least one magnetic conduit 9 being located in close proximity to individual electrodes 2. On this first hydrophobic surface 5, a liquid droplet 8-1 (on the left) and a liquid portion 8-2 (on the right) are shown. The magnetically responsive beads 11 in the liquid droplet 8-1 and in the liquid portion 8-2 are attracted by the magnetic conduits 9' such that they are located on-top of the magnetic conduits 9'.

In general, the specific magnetic conduits 9 according to the present invention preferably consist of or comprises material with the potential for a high degree of magnetization. The type of material that can be a ferromagnetic element (iron, nickel, cobalt) or an alloy (permalloy, Kovar, mu-metal, stainless-steel 410). The specific magnetic conduits 9 according to the present invention may comprise a single solid ferromagnetic element, or of a multitude of randomly orientated ferromagnetic elements (e.g. metallic shavings, preferably iron shavings), or of an amorphous paste filled with ferromagnetic material (e.g. magnetic epoxy). Preferably, the ferromagnetic material is kept inside a magnetic conduit 9 with epoxy or with a tape at the bottom of the magnetic conduit 9 or of the PCB 3.

According to a first preferred embodiment, the at least one magnetic conduit 9 is a cylindrical, cuboid magnetic conduit 9'. Other geometrical forms of cuboid magnetic conduits 9', such as having e.g. a polygonal or elliptic cross-section may be preferred as well. According to a second preferred embodiment, the at least one magnetic conduit 9 is a conical, pyramidal magnetic conduit 9". Other geometrical forms of pyramidal magnetic conduits 9", such as having e.g. a polygonal or elliptic base area may be preferred as well. Other preferred shapes of magnetic conduits 9 comprise cubes, cylinders, cones, and spheres.

The magnets 10 underneath the PCB 3 and magnetic conduits 9 can consist of individual cylindrical permanent magnets, or of a linear array or group of cylindrical permanent magnets in parallel, or of a single large magnetic bar.

In general, the specific magnetic conduits 9 according to the present invention can be located in a through hole 16 or in a blind hole 15. Blind holes 15 provide less magnetic coupling than the through holes 16. Both allow the use of vertical electrical vias in the PCB 3. The blind holes 15 allow better electrical insulation and pressure difference between the uppermost surface 22 of the cartridge accommodation site 18 or PCB 3 and the bottom surface of the PCB or first substrate 3. Typically but not exclusively, the voltage in a digital microfluidics system 1 is applied in pulses to one or more selected electrodes 2' that define one or more paths for one or more liquid portions 8-2 or liquid droplets 8-1 (see for example US 2013/0134040 A1 and US 2013/0175169 A1, herein incorporated by reference in their entirety).

Preferably and in general, the backing magnet 10 is configured as a permanent magnet 10', or as a switchable permanent magnet 10", or as an electromagnet 10'". Most preferred are permanent magnets 10' or switchable permanent magnets 10".

Such backing magnets 10 may be activated by a selection of the following alternatives:

a) Moving a permanent magnet 10' to the backside of the at least one specific magnetic conduit 9. Such moving a permanent magnet 10' may be carried out e.g. by lifting, or by swinging, or by rotating the permanent magnet 10' until its magnetic field is aligned with the at least one specific magnetic conduit 9. Means for enabling such moving a permanent magnet 10' to the backside of the at least one specific magnetic conduit 9 may be conceived by a person of average skill in the art. Such means preferably comprise a support 35 for holding at least one backing magnet 10.

b) Switching on a switchable permanent magnet 10" that is located at the backside of the at least one specific magnetic conduit 9. Such switching on a switchable permanent magnet 10" may be carried out e.g. by turning a permanent magnet into an "ON" position of a magnetic base 29 or by switching off an electromagnet 33 that is compensating the magnetic field of a PE-mag-net 32. A particularly preferred PE-magnet is the ITS-PE 1212-24VDC-TEC of M RED MAGNETICS® (Intertec Components GmbH, 85356 Freising, Germany).

c) Energizing an electromagnet 10''' that is located at the backside of the at least one specific magnetic conduit 9.

FIG. 8 shows a biplanar setup of a digital microfluidics system 1 in a cross section view with one cylindrical, cuboid magnetic conduit 9' and of one conical, pyramidal magnetic conduit 9" located in a PCB or first substrate 3. The digital microfluidics system 1 comprises a number or an array of individual electrodes 2 that are attached to a first substrate or PCB 3. A first hydrophobic surface 5 is located on the individual electrodes 2 and a second hydrophobic surface 6 is located on a second substrate 36. Between the first substrate 5 and the second substrate 36 there is a working gap 4 in which electrowetting is to be performed. The second substrate 36 may be removable from the first substrate 3 (i.e. as a part of a disposable cartridge 17; see parenthesis and reference number 17 on the right of the FIGS. 8-12) or not (i.e. as a part of the microfluidics system 1). Preferably, the microfluidics system 1 comprises a cartridge accommodation site 18 that is configured for taking up a disposable cartridge 17 (see for example US 2013/0134040 A1). The disposable cartridge 17 preferably comprises the first hydrophobic surface 5 that belongs to a working film 19 of the disposable cartridge 17, a second hydrophobic surface 6 that belongs to a cover plate 20 of the disposable cartridge 17, and a working gap 4 that is located in-between the two hydrophobic surfaces 5,6. In this case, a relatively thin, flexible cover plate 20 is shown as a part of a disposable cartridge 17.

A central control unit 7 is in operative contact with the individual electrodes 2 (see contact lines drawn in the first substrate) for controlling selection and for providing a number of individual electrodes 2 that define a path of individual electrodes 2' (see FIGS. 1 and 2) with voltage for manipulating liquid portions 8-2 or liquid droplets 8-1 by electrowetting. As depicted, one pyramidal magnetic conduit 9" and one cylindrical, cuboid magnetic conduits 9' are located in a PCB or first substrate 3. Both magnetic conduits 9 are backed with an individual backing magnet 10 in each case. Both magnetic conduits 9 are backed with individual backing magnets 10 that—unlike as shown in FIG. 7—are held by a common support 35. The left, pyramidal magnetic conduit 9" is located in a blind hole 15 below a space 14 between two narrowed electrodes 2". Thus, said at least one specific magnetic conduit 9 is located beside of and is not covered by at least one individual electrode 2. The right magnetic conduit 9' is located in a through hole 16 in a central void 13 of an individual electrode 2. Thus, said at least one specific magnetic conduit 9 is located beside of and is not covered by at least one individual electrode 2.

As shown, in the first substrate 3 of the microfluidics system 1 and below the individual electrodes 2 there is located at least one magnetic conduit 9 that is configured to be backed by a backing magnet 10, said at least one magnetic conduit 9 being located in close proximity to individual electrodes 2. On this first hydrophobic surface 5, a liquid droplet 8-1 (on the left) and a liquid portion 8-2 (on the right) are shown. The magnetically responsive beads 11 in the liquid droplet 8-1 and in the liquid portion 8-2 are attracted by the magnetic conduits 9',9" such that some of them already are located on-top of the magnetic conduits 9',9".

FIG. 9 shows a biplanar setup of a digital microfluidics system 1 in a cross section view with two conical, pyramidal magnetic conduits 9" located in a PCB or first substrate 3 and backed by a single, large backing magnet 10. Representative for the generally possible embodiments of backing magnets 10 (see above), the reference signs here indicate that backing magnet 10 may be configured as a permanent magnet 10', or as a switchable permanent magnet 10", or as an electromagnet 10'''.

Both magnetic conduits 9" are located in each case in a blind hole 15, the left one below a space 14 between two narrowed electrodes 2" and the right one below a central void 13 of an electrode 2. The digital microfluidics system 1 comprises a number or an array of individual electrodes 2 that are attached to a first substrate or PCB 3. A first hydrophobic surface 5 is located on the individual electrodes 2 and a second hydrophobic surface 6 is located on a second substrate 36. Between the first substrate 5 and the second substrate 6 there is a working gap 4 in which electrowetting is to be performed. The second substrate 36 may be removable from the first substrate 3 (i.e. as a part of a disposable cartridge 17; see parenthesis and reference number 17 on the right of the FIGS. 8-12) or not (i.e. as a part of the microfluidics system 1). Preferably, the microfluidics system 1 comprises a cartridge accommodation site 18 that is configured for taking up a disposable cartridge 17 (see for example US 2013/0134040 A1). The disposable cartridge 17 preferably comprises the first hydrophobic surface 5 that belongs to a working film 19 of the disposable cartridge 17, a second hydrophobic surface 6 that belongs to a cover plate 20 of the disposable cartridge 17, and a working gap 4 that is located in-between the two hydrophobic surfaces 5,6. In this case, a relatively thick, rigid cover plate 20 is shown as a part of a disposable cartridge 17.

A central control unit 7 is in operative contact with the individual electrodes 2 (see contact lines drawn in the first substrate) for controlling selection and for providing a number of individual electrodes 2 that define a path of individual electrodes 2' (see FIGS. 1 and 2) with voltage for manipulating liquid portions 8-2 or liquid droplets 8-1 by electrowetting. As depicted, both pyramidal magnetic conduits 9" are located in a PCB or first substrate 3. Both magnetic conduits 9 are backed with a common backing magnet 10, which is held by an individual support 35.

The left pyramidal magnetic conduit 9" is located in a blind hole 15 below a space 14 between two narrowed electrodes 2". The right pyramidal magnetic conduit 9" is located in a through hole 16 in a central void 13 of an individual electrode 2. Thus, both specific magnetic conduits 9" are located beside of and are not covered by at least one individual electrode 2.

As shown, in the first substrate 3 of the microfluidics system 1 and below the individual electrodes 2 there is located at least one magnetic conduit 9 that is configured to be backed by a backing magnet 10, said at least one magnetic conduit 9 being located in close proximity to individual electrodes 2. On this first hydrophobic surface 5, a liquid droplet 8-1 (on the left) and a liquid portion 8-2 (on the right) are shown. The magnetically responsive beads 11 in the liquid droplet 8-1 and in the liquid portion 8-2 are attracted by the magnetic conduits 9" such that most of them already are located on-top of the magnetic conduits 9".

FIG. 10 shows a biplanar setup of a digital microfluidics system 1 in a cross section view with two conical, pyramidal magnetic conduits 9" located in a PCB or first substrate 3 and in each case backed by an individual backing magnet 10. In a first blind hole 15 of a preferably rigid cover-plate 20 of a disposable cartridge 17 that is accommodated on the PCB (or in a second substrate 36 of the digital microfluidics system 1), there is aligned with one of these magnetic conduits 9" in the PCB 3 and backed with an cooperating magnet 26 a conical, pyramidal cooperating magnetic conduit 25. In a second blind hole 15 of the preferably rigid cover-plate 20 of a disposable cartridge 17 that is accommodated on the PCB (or in the second substrate 36 of the digital microfluidics system 1), there is aligned with the other magnetic conduit 9" in the PCB or first substrate 3 a cooperating magnet 26. Both magnetic conduits 9" are backed with individual backing magnets 10 that—like as shown in FIG. 7—are held by an individual support 35 in each case. Both magnetic conduits 9" are located in each case in a blind hole 15, the left one below a space 14 between two narrowed electrodes 2" and the right one below a central void 13 of an electrode 2. Thus, both specific magnetic conduits 9" are located beside of and are not covered by at least one individual electrode 2.

The digital microfluidics system 1 comprises a number or an array of individual electrodes 2 that are attached to a first substrate or PCB 3. A first hydrophobic surface 5 is located on the individual electrodes 2 and a second hydrophobic surface 6 is located on a second substrate 36. Between the first substrate 5 and the second substrate 36 there is a working gap 4 in which electrowetting is to be per-formed. The second substrate 36 may be removable from the first substrate 3 (i.e. as a part of a disposable cartridge 17; see parenthesis and reference number 17 on the right of the FIGS. 8-12) or not (i.e. as a part of the microfluidics system 1). Preferably, the microfluidics system 1 comprises a cartridge accommodation site 18 that is configured for taking up a disposable cartridge 17 (see for example US 2013/0134040 A1). The disposable cartridge 17 preferably comprises the first hydrophobic surface 5 that belongs to a working film 19 of the disposable cartridge 17, a second hydrophobic surface 6 that belongs to a cover plate 20 of the disposable cartridge 17, and a working gap 4 that is located in-between the two hydrophobic surfaces 5,6. In this case, a relatively thick, rigid cover plate 20 is shown as a part of a disposable cartridge 17.

A central control unit 7 is in operative contact with the individual electrodes 2 (see contact lines drawn in the first substrate) for controlling selection and for providing a number of individual electrodes 2 that define a path of individual electrodes 2' (see FIGS. 1 and 2) with voltage for manipulating liquid portions 8-2 or liquid droplets 8-1 by electrowetting. As depicted, both pyramidal magnetic conduits 9" are located in a PCB or first substrate 3.

As shown, in the first substrate 3 of the microfluidics system 1 and below the individual electrodes 2 there is located at least one magnetic conduit 9 that is configured to be backed by a backing magnet 10, said at least one magnetic conduit 9 being located in close proximity to individual electrodes 2. On this first hydrophobic surface 5, a liquid droplet 8-1 (on the left) and a liquid portion 8-2 (on the right) are shown. The magnetically responsive beads 11 in the liquid droplet 8-1 and in the liquid portion 8-2 are attracted by the magnetic conduits 9" such that most of them already are located on-top of the magnetic conduits 9".

Arrangement of magnetic conduits 9 in the PCB 3 and of aligned cooperating magnetic conduits 25 and cooperating magnets 26 results in stronger magnetic forces that are precisely directed to the liquid droplets 8-1 or liquid portions 8-2 that contain magnetically responsive beads 11.

Alternative methods for achieving stronger magnetic forces comprise the provision of larger magnets underneath the PCB 3. However, such simplistic approach has four major limitations and drawbacks:

1) The diameter of a cylindrical permanent magnet dictates the spacing of the neighboring electrodes on which droplets can move by electrowetting; increased spacing reduces the number of samples or operations that can be worked on or performed in a given area (e.g. in a single cartridge 17).
2) Larger permanent magnets create larger zones where the magnetic force is weak resulting in a significant amount of liquid left with a pellet of magnetically responsive beads.
3) Larger permanent magnets create a diffuse magnetic gradient which makes the point at which the magnetically responsive beads will collect poorly-defined resulting in differing efficiencies of bead retention and fluid removal leading to variable results between samples and runs.
4) The PCB 3 and movable magnets must be carefully aligned to create magnetic fields in reproducible locations.

FIG. 11 shows a biplanar setup of a digital microfluidics system 1 in a cross section view with two conical, pyramidal magnetic conduits 9" located in blind holes 15 of a PCB or first substrate 3. Each magnetic conduit 9" is backed by an individual switchable permanent magnet 10" configured as a magnetic base 29. The left switchable permanent magnet 10" or magnetic base 29 is turned "OFF" by directing the magnetic field (North and South) to an intermediate material 37 of the magnetic base 29 and the right switchable permanent magnet 10" or magnetic base 29 being turned "ON" by directing the magnetic field (North and South) to the iron blocks 31 of the magnetic base 29. Both magnetic conduits 9" are backed with individual backing magnets 10 that—unlike as shown in FIGS. 7 and 10, but as shown in FIGS. 8 and 9—are held by a common support 35. Both magnetic conduits 9" are located in each case in a blind hole 15 and both below a space 14 between two narrowed electrodes 2". Thus, both specific magnetic conduits 9" are located beside of and are not covered by at least one individual electrode 2.

The digital microfluidics system 1 comprises a number or an array of individual electrodes 2 that are attached to a first substrate or PCB 3. A first hydrophobic surface 5 is located on the individual electrodes 2 and a second hydrophobic surface 6 is located on a second substrate 36. Between the first substrate 5 and the second substrate 36 there is a working gap 4 in which electrowetting is to be performed. The second substrate 36 may be removable from the first substrate 3 (i.e. as a part of a disposable cartridge 17; see parenthesis and reference number 17 on the right of the FIGS. 8-12) or not (i.e. as a part of the microfluidics system 1). Preferably, the microfluidics system 1 comprises a cartridge accommodation site 18 that is configured for taking up a disposable cartridge 17 (see for example US 2013/0134040 A1). The disposable cartridge 17 preferably comprises the first hydrophobic surface 5 that belongs to a working film 19 of the disposable cartridge 17, a second hydrophobic surface 6 that belongs to a cover plate 20 of the disposable cartridge 17, and a working gap 4 that is located in-between the two hydrophobic surfaces 5,6. In this case, a relatively thick, rigid cover plate 20 is shown as a part of a disposable cartridge 17.

A central control unit 7 is in operative contact with the individual electrodes 2 (see contact lines drawn in the first substrate) for controlling selection and for providing a number of individual electrodes 2 that define a path of individual electrodes 2' (see FIGS. 1 and 2) with voltage for manipulating liquid portions 8-2 or liquid droplets 8-1 by electrowetting. As depicted, both pyramidal magnetic conduits 9" are located in a PCB or first substrate 3. Both magnetic conduits 9 are backed with a common backing magnet 10, which is held by a common support 35.

As shown, in the first substrate 3 of the microfluidics system 1 and below the individual electrodes 2 there is located at least one magnetic conduit 9 that is configured to be backed by a backing magnet 10, said at least one magnetic conduit 9 being located in close proximity to individual electrodes 2. On this first hydrophobic surface 5, a liquid droplet 8-1 (on the left) and a liquid portion 8-2 (on the right) are shown. On the one hand, the magnetically responsive beads 11 in the liquid droplet 8-1 are not attracted by the magnetic conduit 9", because the magnetic field of the turnable permanent magnet 30 is directed to the intermediate material 37 of the magnetic base 29. On the other hand, the magnetically responsive beads 11 in the liquid portion 8-2 are attracted by the magnetic conduit 9", because the magnetic field of the turnable permanent magnet 30 is directed to the iron blocks 31 of the magnetic base 29. A short description of the working behavior of such a magnetic base 29 which field can be enclosed into a material with high magnetic permeability can be found in the Internet under https://en.wikipedia.org/wiki/Magnetic_base. Means for enabling such turning a turnable permanent magnet 30 may be conceived by a person of average skill in the art. Such means preferably comprise a support 35 for holding at least one backing magnet 10.

FIG. 12 shows a biplanar setup of a digital microfluidics system 1 in a cross section view with two conical, pyramidal magnetic conduits 9" located in blind holes 15 of a PCB or first substrate 3. Each magnetic conduit 9" is backed by an individual switchable permanent magnet 10" configured as a PE-magnet 32. The left PE-magnet 32 is turned "OFF" by energizing (see spark) the electromagnet 33 that now compensates the magnetic field of the permanent magnet 34 and the right PE-magnet 32 is turned "ON" by de-activating (see crossed spark) the electromagnet 33 that no longer compensates the magnetic field of the permanent magnet 34.

Both magnetic conduits 9" are backed with individual backing magnets 10 that—like as shown in FIGS. 8 and 11—are held by a common support 35 (preferably fixed by screws as shown). Both magnetic conduits 9" are located in each case in a blind hole 15 and below a space 14 between two narrowed electrodes 2". Thus, both specific magnetic conduits 9" are located beside of and are not covered by at least one individual electrode 2.

The digital microfluidics system 1 comprises a number or an array of individual electrodes 2 that are attached to a first substrate or PCB 3. A first hydrophobic surface 5 is located on the individual electrodes 2 and a second hydrophobic surface 6 is located on a second substrate 36. Between the first substrate 5 and the second substrate 36 there is a working gap 4 in which electrowetting is to be performed. The second substrate 36 may be removable from the first substrate 3 (i.e. as a part of a disposable cartridge 17; see parenthesis and reference number 17 on the right of the FIGS. 8-12) or not (i.e. as a part of the microfluidics system 1). Preferably, the microfluidics system 1 comprises a cartridge accommodation site 18 that is configured for taking up a disposable cartridge 17 (see for example US 2013/0134040). The disposable cartridge 17 preferably comprises the first hydrophobic surface 5 that belongs to a working film 19 of the disposable cartridge 17, a second hydrophobic surface 6 that belongs to a cover plate 20 of the disposable cartridge 17, and a working gap 4 that is located in-between the two hydrophobic surfaces 5,6. In this case, a relatively thick, rigid cover plate 20 is shown as a part of a disposable cartridge 17.

A central control unit 7 is in operative contact with the individual electrodes 2 (see contact lines drawn in the first substrate) for controlling selection and for providing a number of individual electrodes 2 that define a path of individual electrodes 2' (see FIGS. 1 and 2) with voltage for manipulating liquid portions 8-2 or liquid droplets 8-1 by electrowetting. As depicted, both pyramidal magnetic conduits 9" are located in a PCB or first substrate 3. Both magnetic conduits 9 are backed with a common backing magnet 10, which is held by a common support 35.

As shown, in the first substrate 3 of the microfluidics system 1 and below the individual electrodes 2 there is located at least one magnetic conduit 9 that is configured to be backed by a backing magnet 10, said at least one magnetic conduit 9 being located in close proximity to individual electrodes 2. On this first hydrophobic surface 5, a liquid droplet 8-1 (on the left) and a liquid portion 8-2 (on the right) are shown. On the one hand, the magnetically responsive beads 11 in the liquid droplet 8-1 are not attracted by the magnetic conduit 9", because the magnetic field of the permanent magnet 34 of the PE-magnet 32 is compensated by the activated electromagnet 33 of the PE-magnet 32. On the other hand, the magnetically responsive beads 11 in the liquid portion 8-2 are attracted by the magnetic conduit 9", because the magnetic field of the permanent magnet 34 of the PE-magnet 32 is no longer compensated by the de-activated electromagnet 33 of the PE-magnet 32. Such PE-magnets 32 (e.g. ITS-PE 1212—24VDC-TEC of M RED MAGNETICS® (Intertec Components GmbH, 85356 Freising, Germany) may have a diameter of 12 mm, a height of 12 mm, and work with 24 V DC. A great advantage of using such PE-magnets 32 is the fact that absolutely no moving parts are involved or necessary for switching on and off the switchable permanent magnets 10".

Preferably, a disposable cartridge 17 is utilized for manipulating liquid droplets 8-1,8-1' or liquid portions 8-2, 8-2' in a microfluidics system 1. Such a disposable cartridge 17 may belong to the microfluidics system 1 or may be separately provided for use in the microfluidics system 1 that further comprises a cartridge accommodation site 18 that is configured for taking up a disposable cartridge 17. Such disposable cartridge preferably comprises the first hydrophobic surface 5 that belongs to a working film 19 of the disposable cartridge 17, a second hydrophobic surface 6 that belongs to a cover plate 20 of the disposable cartridge 17, and a working gap 4 that is located in-between the two hydrophobic surfaces 5,6. The working film 19 may e.g. comprise a hydrophobic layer with a first hydrophobic surface 5 and an underlying dielectric layer. Alternatively, the working film 19 may e.g. consist of a dielectric layer that is provided with a first hydrophobic surface 5.

Preferably, the disposable cartridge 17—whether provided with the digital microfluidics system 1 or not—comprises a cover-plate 20. Especially preferably and aligned with one of said magnetic conduits 9 in the first substrate 3 of the digital microfluidics system 1, there are blind holes 15 located in said rigid cover-plate 20 of the disposable cartridge 17. In these blind holes 15, preferably there are located a cooperating magnetic conduit 25 which is backed with a backing magnet 10 or a cooperating magnet 26 (see FIG. 10).

In consequence, such a disposable cartridge 17 is configured for being accommodated at a cartridge accommodation site 18 of a digital microfluidics system 1. This disposable cartridge 17 comprises the first hydrophobic surface 5 that belongs to a working film 19, a second hydrophobic surface 6 that belongs to a cover plate 20 of the disposable cartridge 17, and a working gap 4 that is located in-between the two hydrophobic surfaces 5,6. Preferably, the working film 19 of the disposable cartridge 17 comprises a backside 21 that, when the disposable cartridge 17 is accommodated on a cartridge accommodation site 18 of the digital microfluidics system 1, touches an uppermost surface 22 of the cartridge accommodation site 18 of the digital microfluidics system 1. Especially preferred is that the cover plate 20 of the disposable cartridge 17 is configured as a rigid cover plate or as a flexible cover plate.

When the cover plate 20 of the disposable cartridge 17 is configured as a rigid cover plate, the working film 19 of the disposable cartridge 17 is configured as a flexible sheet that spreads on the uppermost surface 22 of the cartridge accommodation site 18 of the digital microfluidics system 1. Such spreading of the working film 19 is achieved by the digital microfluidics system 1 that for this purpose comprises a vacuum source 23. This vacuum source 23 of the digital microfluidics system 1 is configured for establishing an underpressure in an evacuation space 24 between the uppermost surface 22 of the cartridge accommodation site 18 and the backside 21 of the working film 19 of a disposable cartridge 17 that is accommodated at the cartridge accommodation site 18 (see FIGS. 8-12 and e.g. US 2013/0134040 A1).

Especially preferred is that the disposable cartridge 17 or the cartridge accommodation site 18 of the digital microfluidics system 1 comprise a gasket 27 that sealingly encloses said evacuation space 24 and that defines a height 28 of the working gap 4 between said hydrophobic surfaces 5,6 of the disposable cartridge 17. The gasket 27 may be a part of the disposable cartridge 17 or of the digital microfluidics system 1.

The preferred disposable cartridge 17 may comprise blind holes 15 in said rigid cover-plate 20, and when the disposable cartridge 17 is accommodated at cartridge accommodation site 18 of the digital microfluidics system 1, there is aligned with one of these magnetic conduits 9 in the first substrate 3 of the digital microfluidics system 1 a cooperating magnetic conduit 25 that is backed with a backing magnet 10 or a cooperating magnet 26.

It is noted expressly that all features in the shown and described embodiments that appear reasonable to a person of skill may be combined with each and every one of these features. Especially preferred materials and dimensions are disclosed in Table 1 below: Cytop is an amorphous fluoropolymer with high optical transparency (AGC Chemicals Europe). Mylar®, Neoprene®, Teflon®, and Viton® are Trademarks of DuPont, Wilmington, USA.

Preferably, the magnetic conduits 9 are in physical contact or in close proximity to the backing magnet 10 when the magnetic force is enabled. Preferred distances (if there are some) range from 1 μm to 1 mm, more preferably from 1 μm to 100 μm.

In some embodiments, the permanent magnet height is 5 mm-20 mm, preferably 10 mm-15 mm with a diameter of 18 mm-2 mm, preferably 3 mm-7 mm. If a single, large permanent magnet is used, the magnet length can be 30-100 mm, preferably 50 mm-70 mm. The magnetic force generated on a single 1-μm-diameter magnetic bead is 100 fN-10 pN, preferably 500 fN-2 pN.

Even if not particularly described in each case, the reference numbers refer to similar elements of the digital microfluidics system 1 and in particular of the disposable cartridge 17 of the present invention. All drawings are schematic and not to scale.

TABLE 1

| Part | No | Material | Dimensions and Shape |
|---|---|---|---|
| Liquid portion or droplet | 8 | Aqueous, alcohol | Volume: 0.1-5 μl |
| First Substrate | 3 | PCB; Synth. Polymer; Copper | Thickness about 1.6 mm |
| Electrodes | 2 | Al; Cu; Au; Pt | Plating: 1.5 × 1.5 mm |
| Working film | 19 | Fluorinated ethylene propylene (FEP), Cyclo olefin polymer (COP), Polypropylene (PP) | Foil: 8-50 μm |
| 1st hydrophobic surface | 5 | COP, FEP, PP | Foil: 8-50 μm |
| Second substrate or Cover plate | 36 20 | Mylar ®; acrylic; Polypropylene (PP) | Plate: 0.5-10.0 mm; preferably 1.5 mm |
| 2nd hydrophobic surface | 6 | Teflon ® (PTFE), amorphous fluoropolymer | Spin coating: 5-500 nm; preferably 20 nm |
| Gap height | 28 | — | 0.2-2.0 mm; preferably 0.5 mm |
| Pipetting orifice | — | — | Diameter: 0.3-3.0 mm |
| Body | — | Mylar ®; acrylic; Polypropylene (PP) | 65 × 85 mm; 6-25 mm |
| Spacer | — | Steel, aluminum | Frame: 0.2-2.0 mm; preferably 0.5 mm |
| Gasket | 27 | Synthetic or natural rubber | Frame: 0.2-2.0 mm; preferably 0.5 mm |
| Peel off protection film | — | Polyethylene terephthalate (PET) liner; PP; silicone | 70 × 110 mm; 0.1 mm |
| Seal | — | Viton ®; Neoprene ® | O-ring Ø 3.0 mm |
| Insertion guide | — | Al; Al/Mg; steel; Teflon ® (PTFE) | Frame: 5-30 mm |
| Dielectric layer | — | Fluorinated ethylene propylene (FEP) | Foil or casting: 20-100 μm |
| Hydrophobic layer | — | FEP; PTFE; Teflon AF; Cytop; Cytonix | 2-200 nm |
| Oil | — | Silicone | Volume: 1-5 ml |
| Electrically conductive material | — | Au, Pt, ITO, PP, PA | Layer: 20-100 μm; preferably 50 μm |

| Reference numbers | |
|---|---|
| 1 | digital microfluidics system |
| 2 | individual electrodes |
| 2' | path of selected electrodes, droplet path, electrode path |
| 2" | narrowed individual electrode |
| 3 | first substrate or PCB |
| 4 | working gap |
| 5 | first hydrophobic surface |
| 6 | second hydrophobic surface |
| 7 | central control unit |
| 8-1 | liquid droplet with magnetic beads |
| 8-1' | liquid droplet without magnetic beads |
| 8-2 | liquid portion with magnetic beads |
| 8-2' | liquid portion without magnetic beads |
| 8" | small liquid portion with magnetic-beads |
| 9 | magnetic conduit, specific magnetic-conduit |
| 9' | cuboid magnetic conduit |
| 9" | pyramidal magnetic conduit |
| 10 | backing magnet |
| 10' | permanent magnet |
| 10" | switchable permanent magnet |

-continued

| Reference numbers | |
|---|---|
| 10''' | electromagnet |
| 11 | magnetically responsive beads |
| 12 | neighboring notches, notch |
| 13 | central void |
| 14 | space |
| 15 | blind hole |
| 16 | through hole |
| 17 | disposable cartridge |
| 18 | cartridge accommodation site |
| 19 | working film |
| 20 | cover plate |
| 21 | backside of 19 |
| 22 | uppermost surface of 18 |
| 23 | vacuum source |
| 24 | evacuation space |
| 25 | cooperating magnetic conduit |
| 26 | cooperating magnet |
| 27 | gasket |
| 28 | height of 4 |
| 29 | magnetic base |
| 30 | turnable permanent magnet of |
| 31 | iron block of 29 |
| 32 | PE-magnet |
| 33 | electromagnet of 32 |
| 34 | permanent magnet of 32 |
| 35 | support for 10 |
| 36 | second substrate |
| 37 | intermediate material of 29 |

What is claimed is:

1. A method of substantially removing magnetically responsive beads from liquid portions or droplets in digital microfluidics, wherein the method comprises the steps of:

a) providing a digital microfluidics system (1) comprising a number or array of individual electrodes (2) attached to a first substrate (3), a first hydrophobic surface (5) located on said individual electrodes (2), and a central control unit (7) in operative contact with said individual electrodes (2) for controlling selection and for providing a number of said individual electrodes (2) with voltage for manipulating liquid portions (8-2) or liquid droplets (8-1) by electrowetting;

b) providing in the first substrate (3) of the microfluidics system (1) at least one magnetic conduit (9) comprising a backside and being configured to be backed by a backing magnet (10) with a magnetic field and being configured for directing said magnetic field through the magnetic conduit (9) to the first hydrophobic surface (5) on said individual electrodes (2), said at least one magnetic conduit (9) being located in close proximity to individual electrodes (2);

c) providing on the hydrophobic surfaces (5) and above a path of selected electrodes (2') at least one liquid portion (8-2) or liquid droplet (8-1) that comprises magnetically responsive beads (11);

d) moving by electrowetting said at least one liquid portion (8-2) or liquid droplet (8-1) with the magnetically responsive beads (11) on said path of selected electrodes (2') until at least a part of said at least one liquid portion (8-2) or liquid droplet (8-1) is placed atop of at least one specific magnetic conduit (9);

e) actuating the backing magnet (10) so that it is operatively backing the at least one specific magnetic conduit (9), and thus attracting magnetically responsive beads (11) of said at least one liquid portion (8-2) or liquid droplet (8-1) through directing said magnetic field to the first hydrophobic surface (5) on said individual electrodes (2) by the at least one specific magnetic conduit (9) and concentrating attracted magnetically responsive beads (11); and f) while actuating the backing magnet (10), moving by electrowetting said at least one liquid portion (8-2)' or liquid droplet (8-1)' with a substantially decreased number of magnetically responsive beads (11) on said path of selected electrodes (2) away from the specific magnetic conduit (9).

2. The method of claim 1, wherein said at least one specific magnetic conduit (9) consists of a single solid ferromagnetic element, or of a multitude of randomly orientated ferromagnetic elements, or of an amorphous paste filled with ferromagnetic material.

3. The method of claim 1, wherein said at least one specific magnetic conduit (9) is located under and is covered by an individual electrode (2).

4. The method of claim 1, wherein said at least one specific magnetic conduit (9) is located beside of and is not covered by at least one individual electrode (2).

5. The method of claim 1, wherein said backing magnet (10) is used to operatively back at least one specific magnetic conduit (9) and is configured as a permanent magnet (10'), or as a switchable permanent magnet (10''), or as an electromagnet (10''').

6. The method of claim 1, wherein actuating said backing magnet (10) is achieved by:

a) moving a permanent magnet (10') to the backside of the at least one specific magnetic conduit (9); or b) switching on a switchable permanent magnet (10'') that is located at the backside of the at least one specific magnetic conduit (9); or c) energizing an electromagnet (10''') that is located at the backside of the at least one specific magnetic conduit (9).

7. The method of claim 6, wherein moving a permanent magnet (10') is carried out by lifting, or swinging, or rotating the permanent magnet (10') until its magnetic field is aligned with the at least one specific magnetic conduit (9).

8. The method of claim 6, wherein switching on a switchable permanent magnet (10'') is carried out by turning a permanent magnet into an "ON" position of a magnetic base (29) or by switching off an electromagnet (33) that is compensating the magnetic field of a PE-magnet (32).

9. The method of claim 1, wherein said at least one magnetic conduit (9) is located in neighboring notches (12) in-between of two of the individual electrodes (2) or located in a central void (13) of individual electrodes (2) that define this path of selected electrodes (2').

10. The method of claim 1, wherein said at least one magnetic conduit (9) is located in at least one notch (12) at one side, at opposite sides, or at a corner of individual electrodes (2) that define this path of selected electrodes (2').

11. The method of claim 1, wherein said at least one magnetic conduit (9) is located at a side of one narrowed individual electrode (2'') or in a space (14) between two narrowed individual electrodes (2") that define this path of selected electrodes (2').

12. The method of claim 1, wherein said at least one magnetic conduit (9) is a cylindrical, cuboid magnetic conduit (9') located in a blind hole (15) or in a through hole (16) in the first substrate (3) of the digital microfluidics system (1).

13. The method of claim 1, wherein said at least one magnetic conduit (9) is a conical, pyramidal magnetic conduit (9") located in a blind hole (15) in the first substrate (3) of the digital microfluidics system (1).

14. The method of claim 1, wherein a disposable cartridge (17) is provided which is accommodated on a cartridge accommodation site (18) of the digital microfluidics system (1), the disposable cartridge (17) comprising the first hydrophobic surface (5) that belongs to a working film (19) and a second hydrophobic surface (6) that belongs to a cover plate (20) of the disposable cartridge (17), a working gap (4) being located in-between the two hydrophobic surfaces (5,6) of the disposable cartridge (17).

15. The method of claim 14, wherein the working film (19) of the disposable cartridge (17) comprises a backside (21) that, when the disposable cartridge (17) is accommodated on a cartridge accommodation site (18) of the digital microfluidics system (1), touches an uppermost surface (22) of the cartridge accommodation site (18) of the digital microfluidics system (1).

16. The method of claim 14, wherein the cover plate (20) of the disposable cartridge (17) is configured as a rigid cover plate or as a flexible cover plate.

17. The method of claim 15, wherein the cover plate (20) of the disposable cartridge (17) is configured as a rigid cover plate, and wherein the working film (19) of the disposable cartridge (17) is configured as a flexible sheet that spreads on the uppermost surface (22) of the cartridge accommodation site (18) of the digital microfluidics system (1), the digital microfluidics system (1) comprising a vacuum source (23) for establishing an underpressure in an evacuation space (24) between the uppermost surface (22) of the cartridge accommodation site (18) and the backside (21) of the working film (19) of the disposable cartridge (17).

18. The method of claim 17, wherein the cartridge accommodation site (18) of the digital microfluidics system (1) or the disposable cartridge (17) comprise a gasket (27) that sealingly encloses said evacuation space (24) and that defines a height (28) of the working gap (4) between said hydrophobic surfaces (5,6) of the disposable cartridge (17).

19. The method of claim 16, wherein in blind holes (15) of said rigid cover-plate (20) of the disposable cartridge (17), there is aligned with one of said magnetic conduits (9) in the first substrate (3) of the digital microfluidics system (1), a cooperating magnetic conduit (25) that is backed with a backing magnet (10) or a cooperating magnet (26).

20. The method of claim 1, wherein during actuating the backing magnet (10) according to step e), said at least one liquid portion (8-2) or liquid droplet (8-1) with the magnetically responsive beads (11) is moved to and from on said path of individual electrodes (2') by electrowetting in order to support attraction of the magnetically responsive beads (11) by the specific magnetic conduit (9).

21. A method of substantially suspending magnetically responsive beads in liquid portions or droplets in digital microfluidics, wherein the method comprises the steps of:

a) providing a digital microfluidics system (1) comprising a number or array of individual electrodes (2) attached to a first substrate (3), a first hydrophobic surface (5) located on said individual electrodes (2), and a central control unit (7) in operative contact with said individual electrodes (2) for controlling selection and for providing a number of said individual electrodes (2) with voltage for manipulating liquid portions (8-2) or liquid droplets (8-1) by electrowetting;

b) providing in the first substrate (3) of the microfluidics system (1) at least one magnetic conduit (9) comprising a backside and being configured to be backed by a backing magnet (10) with a magnetic field and being configured for directing said magnetic field through the magnetic conduit (9) to the first hydrophobic surface (5) on said individual electrodes (2), said at least one magnetic conduit (9) being located in close proximity to individual electrodes (2);

c) providing on the hydrophobic surface (5) and above a path of selected electrodes (2') at least one liquid portion (8-2') or liquid droplet (8-1') that lacks magnetically responsive beads (11);

d) moving by electrowetting said at least one liquid portion (8-2') or liquid droplet (8-1') without magnetically responsive beads (11) on said path of selected electrodes (2') until at least a part of said at least one liquid portion (8-2') or liquid droplet (8-1') is placed atop of a specific magnetic conduit (9);

e) de-actuating the backing magnet (10) that is operatively backing the specific magnetic conduit (9), and thus releasing magnetically responsive beads (11) that previously had been separated from at least one liquid portion (8-2) or liquid droplet (8-1) by the specific magnetic conduit (9) into said at least one liquid portion (8-2') or liquid droplet (8-1'); and f) while de-actuating the backing magnet (10), moving by electrowetting said at least one liquid portion (8-2) or liquid droplet (8-1) with a substantial number of suspended magnetically responsive beads (11) on said path of individual electrodes (2') away from the specific magnetic conduit (9).

22. The method of claim 21, wherein de-actuating said backing magnet (10) is achieved by:

a) moving a permanent magnet (10') away from the backside of the at least one specific magnetic conduit (9); or b) switching off a switchable permanent magnet (10") that is located at the backside of the at least one specific magnetic conduit (9); or c) de-energizing an electromagnet that is located at the backside of the at least one specific magnetic conduit (9).

23. The method of claim 22, wherein switching off a switchable permanent magnet (10") is carried out by turning a permanent magnet into an "OFF" position of a magnetic base (29) or by switching on an electromagnet (33) to compensate the magnetic field of a PE-magnet (32).

24. The method of claim 21, wherein during de-actuating the backing magnet (10) according to step e), said at least one liquid portion (8-2') or liquid droplet (8-1') without magnetically responsive beads (11) is moved to and from on said path of individual electrodes (2') by electrowetting in order to support releasing of the magnetically responsive beads (11) from the specific magnetic conduit (9) and suspending the magnetically responsive beads (11) in said at least one liquid portion (8-2') or liquid droplet (8-1').

25. A digital microfluidics system configured for substantially removing or suspending magnetically responsive beads from or in liquid portions or droplets, wherein the digital microfluidics system (1) comprises a number or array of individual electrodes (2) attached to a first substrate (3), a first hydrophobic surface (5) located on said individual electrodes (2), and a central control unit (7) in operative contact with said individual electrodes (2) for controlling the selection and for providing a number of said individual electrodes (2) that define a path of individual electrodes (2') with voltage for manipulating liquid portions (8-2) or liquid droplets (8-1) by electrowetting;

and wherein in the first substrate (3) of the microfluidics system (1) there is located at least one magnetic conduit (9) that is configured to be backed by a backing magnet (10), said at least one magnetic conduit (9) being located in close proximity to individual electrodes (2).

26. The digital microfluidics system (1) of claim 25, wherein said at least one specific magnetic conduit (9) consists of a single solid ferromagnetic element, or of a multitude of randomly orientated ferromagnetic elements, or of an amorphous paste filled with ferromagnetic material.

27. The digital microfluidics system (1) of claim 25, wherein said at least one specific magnetic conduit (9) is located under and is covered by an individual electrode (2).

28. The digital microfluidics system (1) of claim 25, wherein said at least one specific magnetic conduit (9) is located beside of and is not covered by at least one individual electrode (2).

29. The digital microfluidics system (1) of claim 25, wherein said backing magnet (10) is configured as a permanent magnet (10'), or as a switchable permanent magnet (10"), or as an electromagnet (10"').

30. The digital microfluidics system (1) of claim 25, wherein said at least one magnetic conduit (9) is located in neighboring notches (12) in-between of two of the individual electrodes (2) or is located in a central void (13) of individual electrodes (2) that define this path of selected electrodes (2').

31. The digital microfluidics system (1) of claim 25, wherein said at least one magnetic conduit (9) is located in at least one notch (12) at one side, at opposite sides, or at a corner of individual electrodes (2) that define this path of selected electrodes (2').

32. The digital microfluidics system (1) of claim 25, wherein said at least one magnetic conduit (9) is located at a side of one narrowed individual electrode (2") or in a space (14) between two narrowed individual electrodes (2") that define this path of selected electrodes (2').

33. The digital microfluidics system (1) of claim 25, wherein said at least one magnetic conduit (9) is a cuboid magnetic conduit (9') located in a blind hole (15) or in a through hole (16) in the first substrate (3) of the digital microfluidics system (1).

34. The digital microfluidics system (1) of claim 25, wherein said at least one magnetic conduit (9) is a conical, pyramidal magnetic conduit (9") located in a blind hole (15) in the first substrate (3) of the digital microfluidics system (1).

35. The digital microfluidics system (1) of claim 25, wherein the microfluidics system (1) further comprises a cartridge accommodation site (18) that is configured for taking up a disposable cartridge (17) which comprises the first hydrophobic surface (5) that belongs to a working film (19), a second hydrophobic surface (6) that belongs to a cover plate (20) of the disposable cartridge (17), and a working gap (4) that is located in-between the two hydrophobic surfaces (5,6).

36. The digital microfluidics system (1) of claim 35, wherein the disposable cartridge (17) of the digital microfluidics system (1) comprises a rigid cover-plate (20), and wherein aligned with one of said magnetic conduits (9) in the first substrate (3) of the digital microfluidics system (1) there are blind holes (15) located in said rigid cover-plate (20) of the disposable cartridge (17), in which blind holes (15) there are located a cooperating magnetic conduit (25) which is backed with a backing magnet (10) or a cooperating magnet (26).

37. A disposable cartridge (17) configured for being accommodated at a cartridge accommodation site (18) of a digital microfluidics system (1) according to claim 35, the disposable cartridge (17) comprising the first hydrophobic surface (5) that belongs to a working film (19), a second hydrophobic surface (6) that belongs to a cover plate (20) of the disposable cartridge (17), and a working gap (4) that is located in-between the two hydrophobic surfaces (5,6).

38. The disposable cartridge (17) of claim 37, wherein the working film (19) of the disposable cartridge (17) comprises a backside (21) that, when the disposable cartridge (17) is accommodated on a cartridge accommodation site (18) of the digital microfluidics system (1), touches an uppermost surface (22) of the cartridge accommodation site (18) of the digital microfluidics system (1).

39. The disposable cartridge (17) of claim 37, wherein the cover plate (20) of the disposable cartridge (17) is configured as a rigid cover plate or as a flexible cover plate.

40. The disposable cartridge (17) of claim 38, wherein the cover plate (20) of the disposable cartridge (17) is configured as a rigid cover plate, and wherein the working film (19) of the disposable cartridge (17) is configured as a flexible sheet that spreads on the uppermost surface (22) of the cartridge accommodation site (18) of the digital microfluidics system (1), the digital microfluidics system (1) comprising a vacuum source (23) for establishing an underpressure in an evacuation space (24) between the uppermost surface

(22) of the cartridge accommodation site (18) and the backside (21) of the working film (19) of the disposable cartridge (17).

41. The disposable cartridge (17) of claim 40, wherein the disposable cartridge (17) or the cartridge accommodation site (18) of the digital microfluidics system (1) comprise a gasket (27) that sealingly encloses said evacuation space (24) and that defines a height (28) of the working gap (4) between said hydrophobic surfaces (5,6) of the disposable cartridge (17).

42. The disposable cartridge (17) of claim 39, wherein in blind holes (15) of said rigid cover-plate (20) of the disposable cartridge (17), there is aligned with one of these magnetic conduits (9) in the first substrate (3) of the digital microfluidics system (1) a cooperating magnetic conduit (25) that is backed with a backing magnet (10) or a cooperating magnet (26).

43. The method of claim 1, wherein said at least one magnetic conduit (9) is located below said individual electrodes (2).

44. The method of claim 21, wherein said at least one magnetic conduit (9) is located below said individual electrodes (2).

45. The digital microfluidics system (1) of claim 25, wherein said at least one magnetic conduit (9) is located below said individual electrodes (2).

* * * * *